US008052551B2

(12) United States Patent
Blotteaux et al.

(10) Patent No.: US 8,052,551 B2
(45) Date of Patent: Nov. 8, 2011

(54) SPORTS APPARATUS SHAFT AND BLADE WITH ADDED IMPACT PROTECTION AND METHOD OF MAKING SAME

(75) Inventors: Ray Blotteaux, Ferndale, WA (US); Justin Roth, Bellingham, WA (US); Michael Thomas Bennett, Bellingham, WA (US)

(73) Assignee: Sport Maska Inc., Quebec (CA)

( * ) Notice: Subject to any disclaimer, the term of this patent is extended or adjusted under 35 U.S.C. 154(b) by 772 days.

(21) Appl. No.: 10/590,701

(22) PCT Filed: Feb. 25, 2005

(86) PCT No.: PCT/CA2005/000309

§ 371 (c)(1), (2), (4) Date: Jul. 28, 2008

(87) PCT Pub. No.: WO2005/082470

PCT Pub. Date: Sep. 9, 2005

(65) Prior Publication Data

US 2010/0323830 A1 Dec. 23, 2010

(30) Foreign Application Priority Data

Feb. 26, 2004 (CA) ..... 2459006
Nov. 25, 2004 (CA) ..... 2489504

(51) Int. Cl.
*A63B 59/14* (2006.01)

(52) U.S. Cl. ..... 473/560; 473/513; 473/563

(58) Field of Classification Search ..... 473/560–563, 473/549–552, 513
See application file for complete search history.

(56) References Cited

U.S. PATENT DOCUMENTS 2,912,245 A * 11/1959 Gardner et al. ..... 473/563
D244,220 S 5/1977 De brey
4,124,208 A * 11/1978 Burns ..... 473/562
5,042,804 A * 8/1991 Uke et al. ..... 473/538
5,435,548 A * 7/1995 Leduke et al. ..... 473/563
5,577,725 A 11/1996 Pagotto et al.
5,603,498 A * 2/1997 Crawford et al. ..... 473/563
5,730,662 A * 3/1998 Rens ..... 473/300
5,749,798 A * 5/1998 Kuebler et al. ..... 473/549

(Continued)

FOREIGN PATENT DOCUMENTS

CA 1099761 A 4/1981

(Continued)

OTHER PUBLICATIONS

TPS Hockey CSRL & CSPRY Rubber-Coated Hockey Sticks, TPS Hockey 2004 Product Catalogue, Jan. 2004.

*Primary Examiner* — Mark Graham
(74) *Attorney, Agent, or Firm* — Birch, Stewart, Kolasch & Birch, LLP

(57) ABSTRACT

The invention pertains to sports shafts to other sports equipment subjected to impact thereon. The longitudinal edges of the sports shaft are replaced with elastomeric material so as to create a series of bumpers along the longitudinal edges providing increased protection and longevity to the stick. The invention also pertains to the blade, as in hockey stick blade, wherein the top surface of the blade is provided with an elastomeric material so as to create a bumper on the top surface. The invention also pertains to a method of fabricating said sports shaft.

46 Claims, 17 Drawing Sheets

U.S. PATENT DOCUMENTS

| | | | | |
|---|---|---|---|---|
| 5,865,696 | A * | 2/1999 | Calapp et al. | 473/561 |
| D435,074 | S | 12/2000 | Dunham | |
| D436,150 | S | 1/2001 | Dunham | |
| 6,500,079 | B1 | 12/2002 | Tucker, Sr. | |
| 6,752,730 | B1 * | 6/2004 | Brine et al. | 473/513 |
| 7,201,678 | B2 * | 4/2007 | Filice et al. | 473/513 |
| 7,556,574 | B2 * | 7/2009 | Morrow et al. | 473/513 |
| 2002/0094891 | A1 * | 7/2002 | Horwood et al. | 473/560 |
| 2002/0160131 | A1 | 10/2002 | Ohira et al. | |
| 2003/0008734 | A1 * | 1/2003 | Tiitola | 473/560 |
| 2006/0252585 | A1 * | 11/2006 | Blotteaux | 473/560 |

FOREIGN PATENT DOCUMENTS

| | | | |
|---|---|---|---|
| CA | 1147767 | A | 6/1983 |
| CA | 2164188 | A1 | 5/1997 |
| CA | 2118887 | C | 3/1999 |
| CA | 2310802 | C | 2/2001 |
| CA | 2392079 | A1 | 12/2002 |

* cited by examiner

SPORTS APPARATUS SHAFT AND BLADE WITH ADDED IMPACT PROTECTION AND METHOD OF MAKING SAME

TECHNICAL FIELD

The invention pertains to shafts and in particular to the shafts of elongated sports equipment or apparatus such as ice hockey stick shafts, field hockey stick shafts, lacrosse shafts and other such shafts. Further, the invention relates to the blades which can be affixed to some sports equipment, such as ice hockey stick shafts, field hockey stick shafts.

BACKGROUND OF THE INVENTION

In sports that utilize equipment having an elongated shaft, the shaft must ideally be both lightweight and strong. However, these two requirements are often incompatible, in that reduction in weight often may cause a loss of strength and vice versa. Ideally, a shaft should have sufficient strength to withstand the stresses and deformation that arise during use and the impacts that it may be subjected to during play. This is particularly true in contact sports such as ice hockey, field hockey, lacrosse, ringuette, and others. Ideally, the elongated shafts used in those sports, must be able to withstand a large number of impacts, which impacts may often be concentrated at the edges, i.e. the corners or angles thereof formed by the meeting of two adjacent lateral sides of the shaft which, over time, may result in increased damage to the structure of the shaft and ultimately, premature failure thereof. The same concerns apply to the blade of a stick, which is subjected to many impacts, particularly on the upper surface.

Hockey sticks (including goalie sticks), field hockey sticks, lacrosse sticks, ringuette sticks and other such sports sticks may have shafts which may be made from a variety of materials including wood, aluminum, plastic and composite materials such as fiberglass, graphite and Kevlar™ or a combination of any of them. Some shafts are full (i.e not hollow), while others comprise four (relatively) thin side walls forming a peripheral box having a hollow core. Most blades are full, i.e. not hollow. Alternatively, some shafts and some blades have a composite construction having various layers of materials sandwiched as a core. Materials are usually selected for their physical properties in an attempt to improve performance, longevity, etc. . . . Some composite shafts may have lower durability, but are still popular because of their light weight and superior stiffness. Wood shafts are cheap, but are not especially light, stiff or durable while aluminum shafts can have a relatively short life as they are prone to bending failure. Cost is often a criterion in material selection. All of these shafts may be particularly vulnerable to failure along their edges, i.e. where one side surface intersects with an adjacent side surface, often at 90°. Impacts are often concentrated at these edges, precisely where there is less material to absorb and dissipate said impacts. The same problem is experienced by the blades. Lastly, sticks that are the subject of repeated impact on their edges rapidly become worn and tired-looking, with paint and decals worn off, and nicks and gouges therein. Some players do not like their equipment looking shabby.

There is therefore a need for a sports apparatus shaft that has an increased ability to withstand impact along its edges.

Accordingly, it is an object of the present invention to provide a sports shaft where there is provided added protection at the edges thereof.

It is another object of the present invention to provide a sports shaft where there is removed some material along at least one longitudinal edge thereof, which material is replaced with another material more suited for absorbing and resisting impacts.

It is another object of the present invention to provide a sports shaft where the shape of the shaft is such that grooves are provided along at least one of the edges so as to provide a volume to be filled with a material more suited for absorbing and resisting impact.

It is another object of the present invention to provide a blade shaft wherein at least one groove is provided along the upper edge so as to provide a volume to be filled with a material more suited for absorbing and resisting impact.

An additional object of the present invention is to provide a sports shaft wherein bumpers are selectively provided on the edges thereof to absorb and distribute the shock of an external impact, ideally in a direction perpendicular to the line of action of impact.

An additional object of the present invention is to provide a sports shaft wherein said bumpers are made from an elastomeric material.

SUMMARY OF THE INVENTION

The present invention, although applicable to any number of shafts for a variety of sports (either player or goalie), will be described with respect to ice hockey stick shafts, i.e. hockey stick shafts for ease of reference. However, one skilled in the art will understand that the scope of the invention is not limited to hockey stick shafts and that it may encompass within its scope all other equipment requiring additional strength at a specific portion thereof. Hockey stick shafts are generally elongated, often up to 63 inches long and generally rectangular in cross section. In particular, a hockey stick shaft may comprise a pair of opposed, major surfaces spaced apart by a pair of opposed minor surfaces forming a regular parallelogram wherein both the pairs of major and minor surfaces are substantially parallel to each other. The major and minor surfaces, or some of them may be substantially flat, concave or convex, or any combination thereof, along their whole length or width, or only along a portion thereof. Generally, a surface (minor or major) may meet its adjacent surface (major or minor) at a 90° angle. Although not widely accepted by users, the present invention may also be used with hockey stick shafts whose major and/or minor surfaces are not parallel to each other, resulting in minor surfaces meeting major surfaces at an angle other than 90°. All or some of the intersection of said surfaces may be sharp, or may have been planed to give it a (slightly) rounded shape or they may be beveled. The present invention applies equally as well to one-piece sticks (having a blade attached thereon) or to replacement shafts, and further applies to individual blades or to blades and shaft combinations. Further, the present invention also applies to those shafts which may not have major and minor surfaces, but which may have surfaces, i.e. 4 or more, which are all of the same size.

The ability of an angle, defined as the intersection of a major surface with a minor surface, to withstand an impact during play is reduced by the limited amount of material adjacent the edge on each of the minor or major surface side. Thus, for example, in a wooden or composite stick, the absence of sufficient material (wood or composite material) to withstand impacts along its edges may reduce the life and serviceability of the shaft. In order to compensate for this limitation resulting from the geometry of the stick, the present invention provides for use of a more durable material disposed on or along one or more of the edges, which material may be better adapted to withstand impacts. Such materials are, for example, elastomeric materials, which materials are of a rubber-like consistency, such that they are adapted to deform under stress or when subjected to impact, thus absorbing the energy of the impact and dissipating it, before returning to their original shape.

In addition to the above, the present invention is also directed to increasing the life of a hockey stick blade. As may be understood, a hockey stick comprises two components, namely an elongated shaft and a blade, often curved, affixed to the lower extremity of the shaft. The underside of the blade is frequently in contact with the ice, while the side walls (of the curved portion of the blade) come into contact with a puck. The upper edge of the blade is often subjected to impacts thereon, from the sticks of other players. This may result in chipping, cracking or premature breaking of the blade along its upper surface, resulting in premature failure of the stick. Thus, the replacement of a portion of the upper surface of the blade with an elastomeric material, or the placing (affixing or molding) of a layer of elastomeric material on the top surface of the blade may result in increasing the life and/or serviceability of the blade.

The invention pertains to a bumper shaft, a blade and a method of making same. In accordance with one embodiment, there is provided for a sports shaft comprising:

an elongated body comprising opposed first and second major side surfaces spacing apart opposed first and second minor side surfaces, each said major surface having two lateral major edges disposed along the length of said elongated body, each said minor surface having two lateral minor edges disposed along the length of the elongated body, each said major edge abutting an adjacent minor edge along its entire length forming four angles along the longitudinal periphery of said body, at least one of said angles comprising a longitudinally disposed groove therein, said groove comprising a first face disposed adjacent said major surface and a second face disposed adjacent said minor surface, said first and second faces each having a margin disposed distally from said major and minor surfaces, said margins abutting each other for the length of the groove, said first face and said second face defining a cavity, said cavity being filled with an elastomeric material, wherein said elastomeric material is selected from a group comprising :thermoset elastomeric urethane, thermoplastic polyurethane thermoset elastomer dicyclopentadiene, thermoplastic elastomer, thermoplastic urethane, silicone, rubber, polyisoprene, polybutadiene, polyisobutylene and latex.

In accordance with a further embodiment, there is provided for a sports shaft comprising:

an elongated body comprising opposed first and second major wall components spacing apart opposed first and second minor wall components, said first major wall component comprising a first shelf component adjacent said first major wall component, said first shelf component projecting from said first major wall component towards said second major wall component, said first shelf component having a first distal end, said first minor wall component comprising a second shelf component adjacent said first major wall component, said second shelf component projecting from said first minor wall component towards said second minor wall component, said second shelf component having a second distal end, wherein said first and second distal ends meet forming a groove on the outside of said elongated body, said groove being filled with an elastomeric material, said elastomeric material is selected from a group comprising: thermoset elastomeric urethane, thermoplastic polyurethane, thermoset elastomer dicyclopentadiene, thermoplastic elastomer, thermoplastic urethane, silicone, rubber, polyisoprene, polybutadiene, polyisobutylene and latex.

In a further embodiment, there is provided for a hockey stick blade comprising:

a blade body having a toe section and an opposed heel section, opposed first and second lateral side faces, said blade body further comprising a bottom surface and an opposed top surface, a groove disposed in said top surface and in said first lateral side surface, said groove comprising a first face disposed adjacent said top surface and a second face disposed adjacent said first lateral side face, said groove being filled with an elastomeric material.

In accordance with a further embodiment, there is provided for a blade wherein said blade body comprises a second groove disposed in said top surface and in said first lateral side face, said second groove comprising a first face disposed adjacent said top surface and a second face disposed adjacent said second lateral side face, said groove being filled with an elastomeric material, wherein said elastomeric material is selected from a group comprising: thermoset elastomeric urethane, thermoplastic ployurethane, thermoset elastomer dicyclopentadiene, thermoplastic elastomer, thermoplastic urethane, silicone, rubber, polyisoprene, polybutadiene, polyisobutylene and latex.

In according to a further embodiment of the present invention, there is provided for a method of fabricating a sports shaft comprising the steps of:

placing a preformed sports shaft comprising an elongated body comprising opposed first and second major side surfaces spacing apart opposed first and second minor side surfaces, each said major surface having two lateral major edges disposed along the length of said elongated body, each said minor surface having two lateral minor edges disposed along the length of said elongated body, each said major edge abutting an adjacent minor edge along its entire length forming four angles along the longitudinal periphery of said body, at least one of said angles comprising a longitudinally disposed groove therein, said groove comprising a first face disposed adjacent said major surface and a second face disposed adjacent said minor surface, said first and second faces each having a margin disposed distally from said major and minor surfaces, said margins abutting each other for the length of the groove, said first face and said second face defining a cavity, into a first mold section, closing a second mold section around said preformed sports shaft, injecting an elastomeric material into the closed mold such that the cavity becomes filled with elastomeric material, removing said sports shaft from said mold.

DETAILED DESCRIPTION

Hockey stick shafts are generally elongated, often up to 63 inches long and generally rectangular in cross section. In particular, a hockey stick shaft may comprise a pair of opposed, major surfaces spaced apart by a pair of opposed minor surfaces forming a regular parallelogram. The major and minor surfaces, or some of them may be flat, concave or convex, or any combination thereof, along their whole length or width, or only on a part thereof. Generally, a surface (minor or major) may meet its adjacent surface (major or minor) at a 90° angle. Although not widely accepted by users, hockey stick shafts may also have major and/or minor surfaces which are not parallel. The intersection of said surfaces may be sharp, or may have been planed to give it a slightly rounded shape. The shaft may be full, may be hollow, filled with foam either along its whole length or just in portions of its length, or solid.

Figure 1:
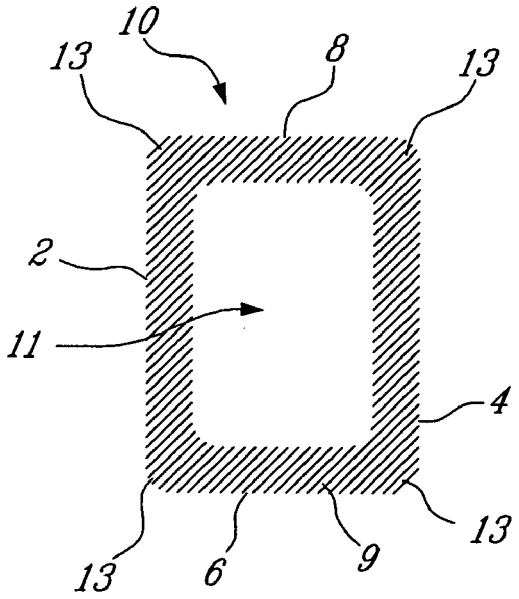
Fig-1 PRIOR ART
FIGS. 1 and 2 illustrate cross sections of examples of prior art rectangular sports apparatus shafts.
Figure 2:
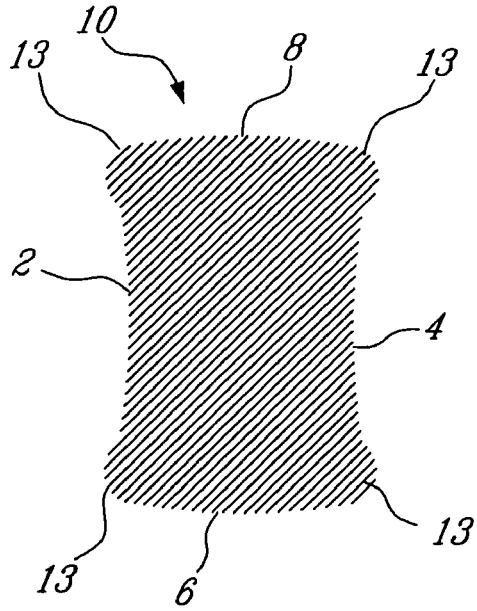
Fig-2 PRIOR ART

FIG. 1 shows a cross section example of a prior art hollow composite hockey stick shaft 10 comprising an empty space 11 within the shaft 10. The shaft 10 comprises a pair of opposed major surfaces 2, 4 spaced apart by a pair of opposed minor surfaces 6, 8, the intersection of the major 2, 4 and minor 6, 8 surfaces forming edge 13 (or angle). FIG. 2 shows a cross section example of a prior art solid hockey stick shaft 10 comprising a pair of opposed, concave major surfaces 2, 4 spaced apart by a pair of opposed convex minor surfaces 6, 8, the intersection of the major 2, 4 and minor 6, 8 surfaces forming edge 13. As may be understood, other hockey stick geometries and/or configurations are possible but all have in common the presence of edges 13 of the same material as their major 2, 4 and minor 6, 8 surfaces, which may be, for example, composite or aluminum in the case of a hollow stick, or wood in the case of a solid stick. Furthermore, hollow sticks may also be filled, in full or in part, with various types of foam, or with other materials.

Figure 3:
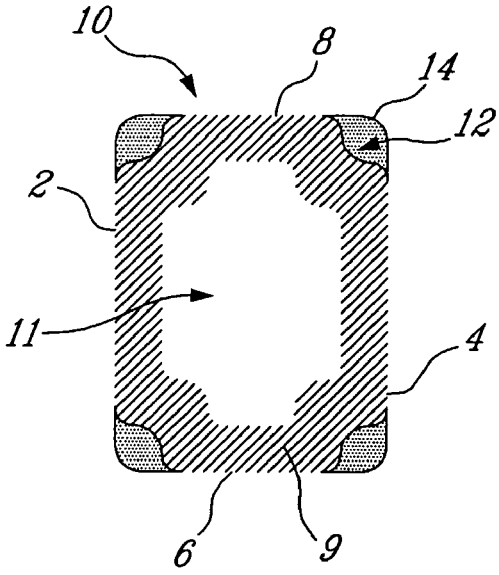
FIGS. 3 and 4 illustrate cross sections of examples of rectangular sports apparatus shafts according to a particular embodiment of the present invention.
Figure 4:
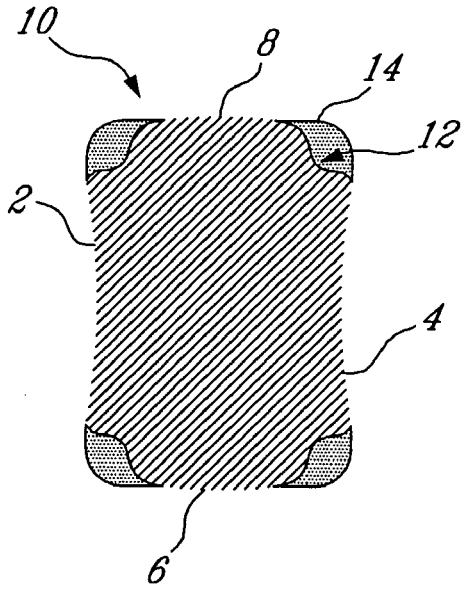
Figure 5:
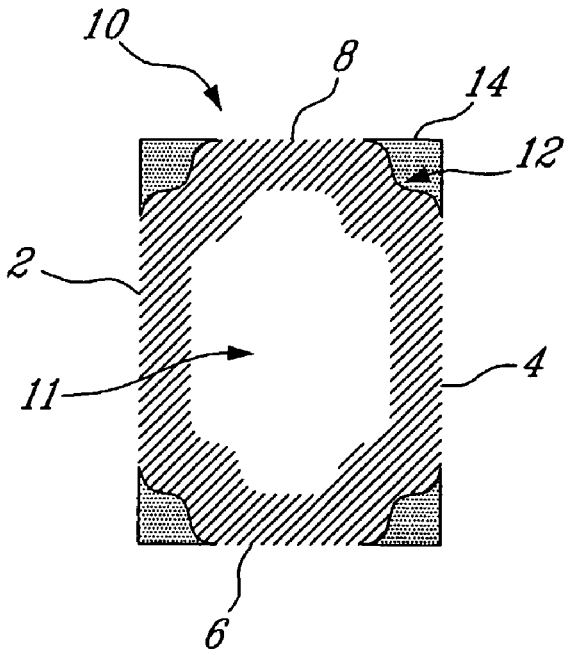
FIGS. 5 and 6 illustrate cross sections of examples of rectangular sports apparatus shafts according to further embodiments of the present invention.
Figure 6:
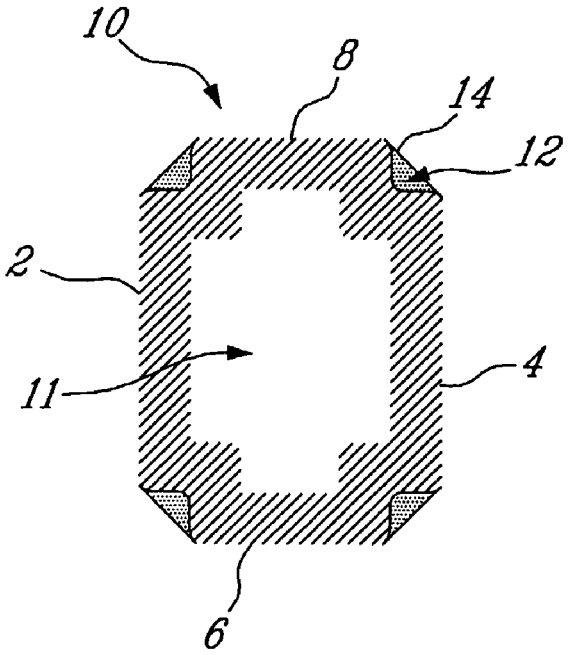

FIGS. 3 and 4 illustrate cross sections of particular embodiments of hockey stick shafts 10 according to the present invention, the shaft 10 comprising grooves 12 at its edges, which grooves serve as receptacles for bumpers 14. The word <<groove>> is to be understood to be synonymous with cavity, depression, space, and is further understood to comprise any receptacle either formed in the shaft when the shaft is being constructed, or carved out, machined, etc. out of a preexisting shaft so as to be able to accept therein elastomeric material. More particularly, FIG. 3 illustrates a hollow composite hockey stick shaft 10 while FIG. 4 illustrates a solid hockey stick shaft. Both FIGS. 3 and 4 have bumpers 14 having a rounded edge so as to provide improved comfort to the user holding the hockey stick shaft 10 although the bumpers 14 may also form a sharp edge as illustrated in FIG. 5, or a flat surface as illustrated in FIG. 6. The shape of the bumper 14 disposed in groove 12 (or cavity) may vary as required or desired. For example, a hockey shaft 10 comprising four bumpers may have two bumpers having rounded edges and two bumpers having sharp edges. Alternatively, a bumper 14 may start near the top of the shaft 10 having a particular shape, and said shape being modified along the length of the bumper 14 as the bumper 14 moves towards the bottom of shaft 10. In particular, bumpers 14 may have indentations or undulations therein along their length so as to create finger marks so as to accommodate the hands of a player thereon. As may be understood, since bumpers 14 are injected in a mold, a very large number of combinations of shapes are possible.

Figure 7:
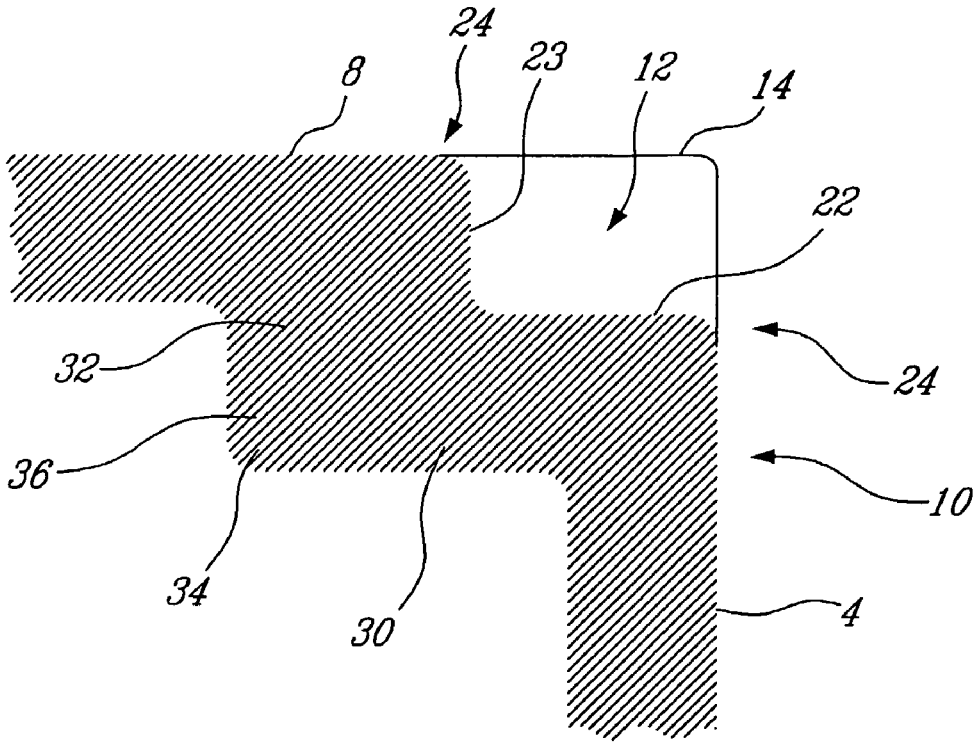
FIGS. 7 and 8 illustrate detailed cross section views of a groove and bumper illustrated in FIGS. 5 and 6 respectively.
Figure 8:
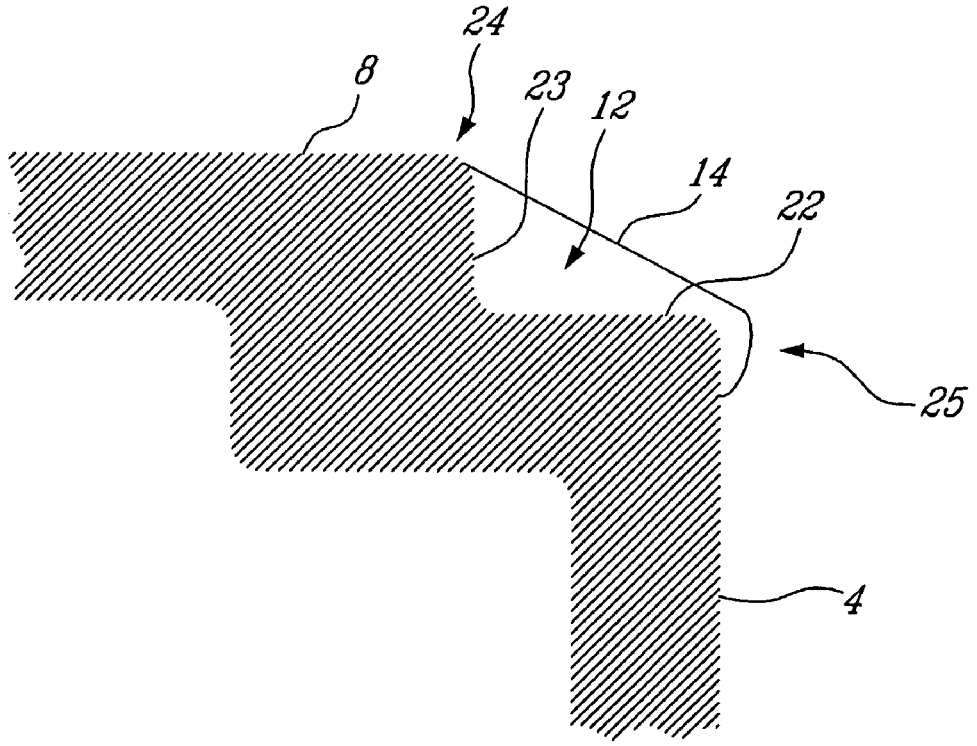

FIGS. 7 and 8 show detailed cross section views of a groove 12 and bumper 14 illustrated in FIGS. 5 and 6 respectively. Groove 12 comprises two surfaces, a first surface (or face) 22 substantially perpendicular to major surface 4 and a second surface 23 relatively perpendicular to minor surface 8. The first 22 and second 23 surfaces of the groove 12 may intersect each other at an angle of approximately 90° and may have a depth which ranges from 0.015" to 0.250" and may range from 0.025" to 0.060". As illustrated in FIG. 7, hockey stick shaft 10 is shown as being hollow, namely being constructed with a series of thin walls forming the periphery of the shaft. As illustrated, major surface 4 does not extend vertically up to the top so as to be flush with minor surface 8. Conversely, minor surface 8 also does not extend longitudinally and therefore ends before being flush with major surface 4. Instead, a shelf component 30 (first shelf component) projects (i.e. extends) from the end of said first major surface 4, i.e. substantially away from major surface 4 and, as illustrated, substantially perpendicular thereto. Shelf component 30 extends from the wall of the shaft 10 until distal end 34. Similarly, a shelf component (second shelf component) 32 projects (i.e. extends) from minor surface 8, adjacent the end of said surface. Similarly, shelf 32 extends from the wall of the shaft 10 until distal end 36. As illustrated, distal end 34 of shelf 30 meets distal end 36 of shelf 32 so as to form a L-shaped portion of the exterior wall component of shaft 10. However it is understood that the size of shelf component 30 and shelf component 32 may have an inversed L-shape, or may be substantially of the same size. As may be seen, the geometry of major surface 4, minor surface 8, shelf component 30 and shelf component 32 creates a depression (or groove or cavity) 12 substantially at the corner or edge of shaft 10. As may be further understood, the thickness of the wall of shaft 10 at major surface 4 may be substantially identical to the thickness of shelf component 30, or alternatively, shelf component 30 may have a different thickness. Similarly, shelf component 32 may have the same wall thickness as adjacent minor surface 8 or may be different. Further, the thickness of shelf component 30 and of shelf component 32 may be identical, or may be different one from the other. As may be understood, the configuration and disposition of shelf component 30 and shelf component 32 may vary from that shown in FIG. 7, for example, as shown in FIGS. 9, 12, 13 and 14. As illustrated in FIGS. 7 and 8, first surface 22 and second surface 23 are shown as having different lengths. However, it will be understood that first surface 22 and second surface 23 may have the same length or alternatively, surface 23 may be longer than surface 22.

The material used for bumper 14 may be any elastomeric material, for example, thermoset elastomeric urethane, although other material may be used such as, thermoset elastomer dicyclopentadiene, thermoplastic elastomers, thermoplastic urethanes, etc. The preceding list is not meant to be exhaustive, and one skilled in the art will understand that other elastomeric materials, or other combination of materials which when combined create elastomeric properties, may be substituted for or used in addition.

Figure 9:
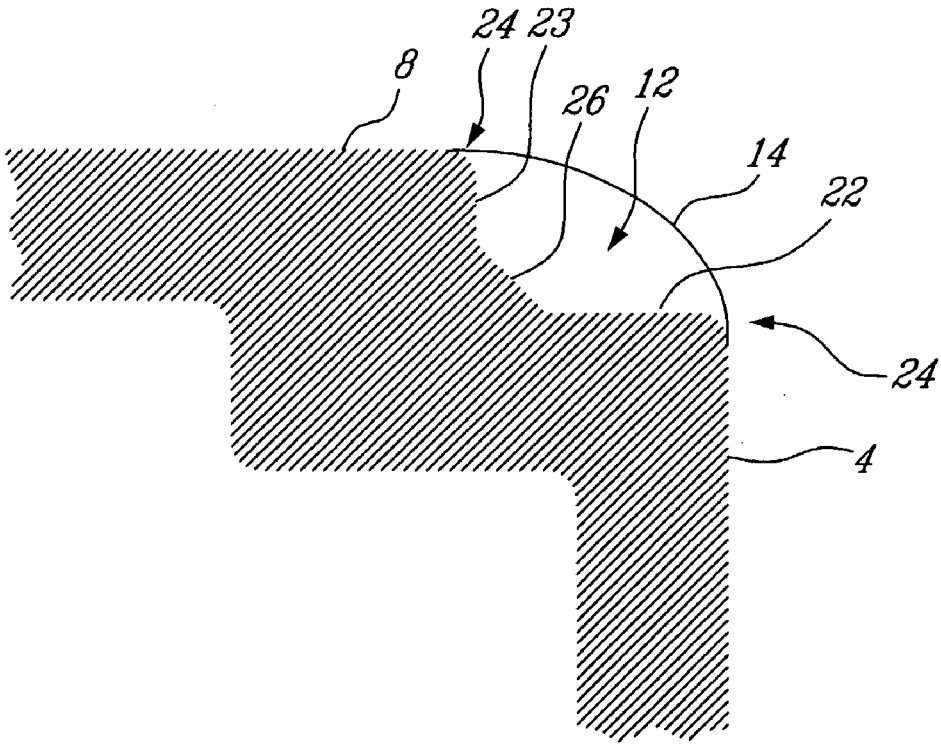
FIGS. 9 and 10 illustrate detailed cross section views of further possible groove and bumper configurations.
Figure 10:
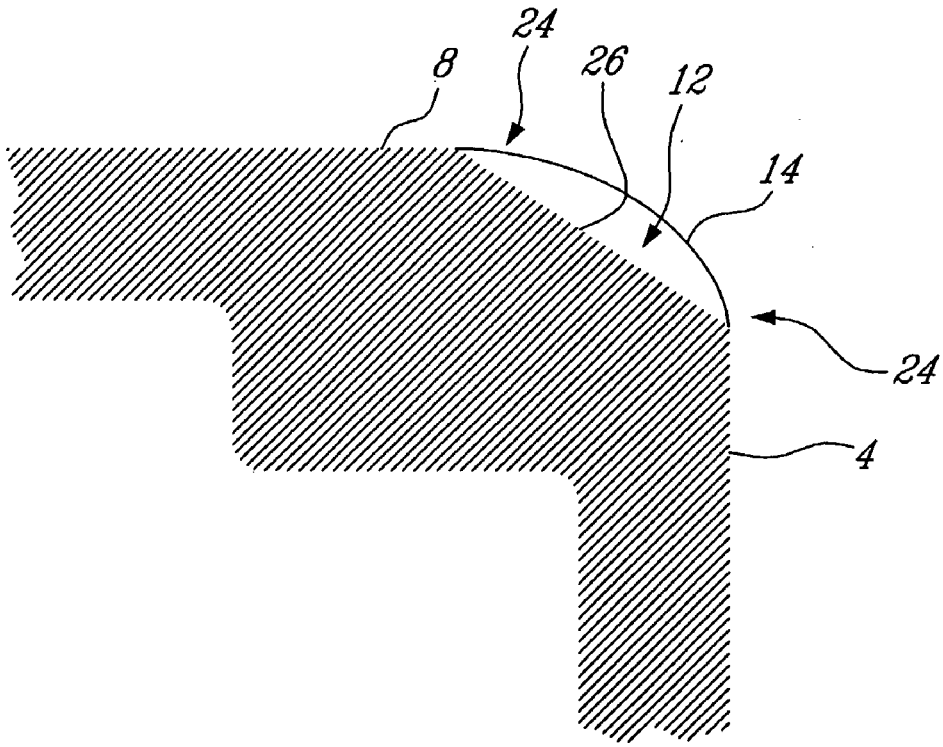

Bumper 14 material may fill groove 12 in a variety of ways. For example, bumper 14 may fill groove 12 such that bumper 14 is flush with, i.e. projects from the plane of minor surface 8 at intersection 24 and is flush with, i.e. projects from the plane of major surface 4 at intersection 24. In this way, there is no step, either up or down with respect to the plane of either of the minor or major surfaces (8,4). Alternatively, there may not be a smooth or even translation between the major and minor surfaces 4, 8 and the bumper 14. For example, as illustrated in FIG. 8, there may be a ridge (i.e. protrusion or bump) 25 which may be formed on major surface 4 adjacent the intersection with first surface 22. Alternatively, bumper 14 may have ridge 25 on both of its extremities, i.e. also near minor surface 8. Also as illustrated in FIG. 8, the top surface of bumper 14 may not be flush with either of the major or minor surfaces 4, 8, but may be curved or inclined. As a further alternative, bumper 14 may comprise a curved or elliptical surface, as illustrated in FIGS. 9 and 10. Further, the surface of the rounded bumper 14, for example, as illustrated in FIG. 9, can extend outwardly away form first surface 22 and second surface 23 such that it markedly extends beyond minor surface 8 and major surface 4, creating a geometry similar to that shown in FIG. 2.

Figure 35:
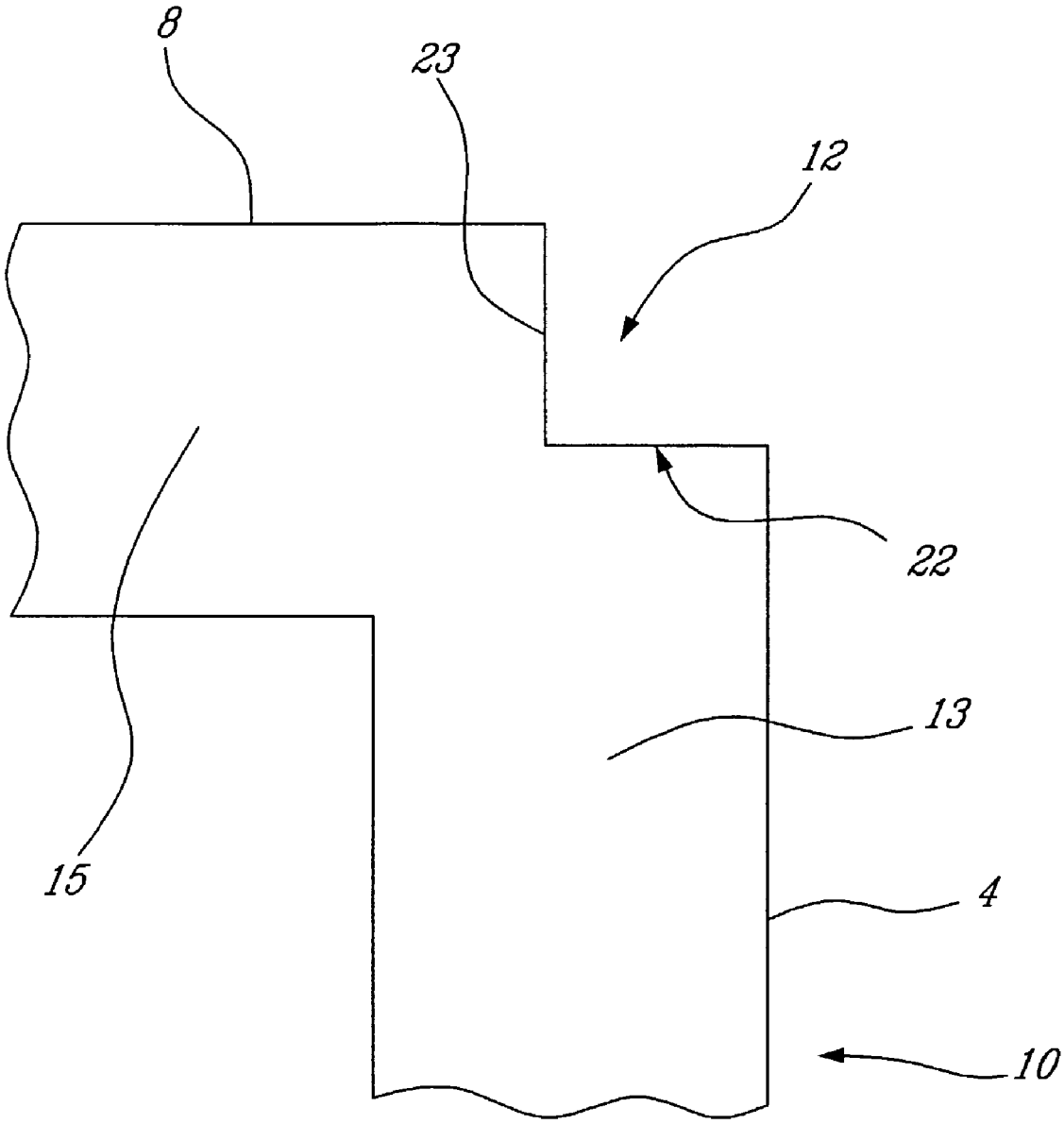
FIG. 35 illustrates an alternative embodiment of a groove construction.
Figure 36:
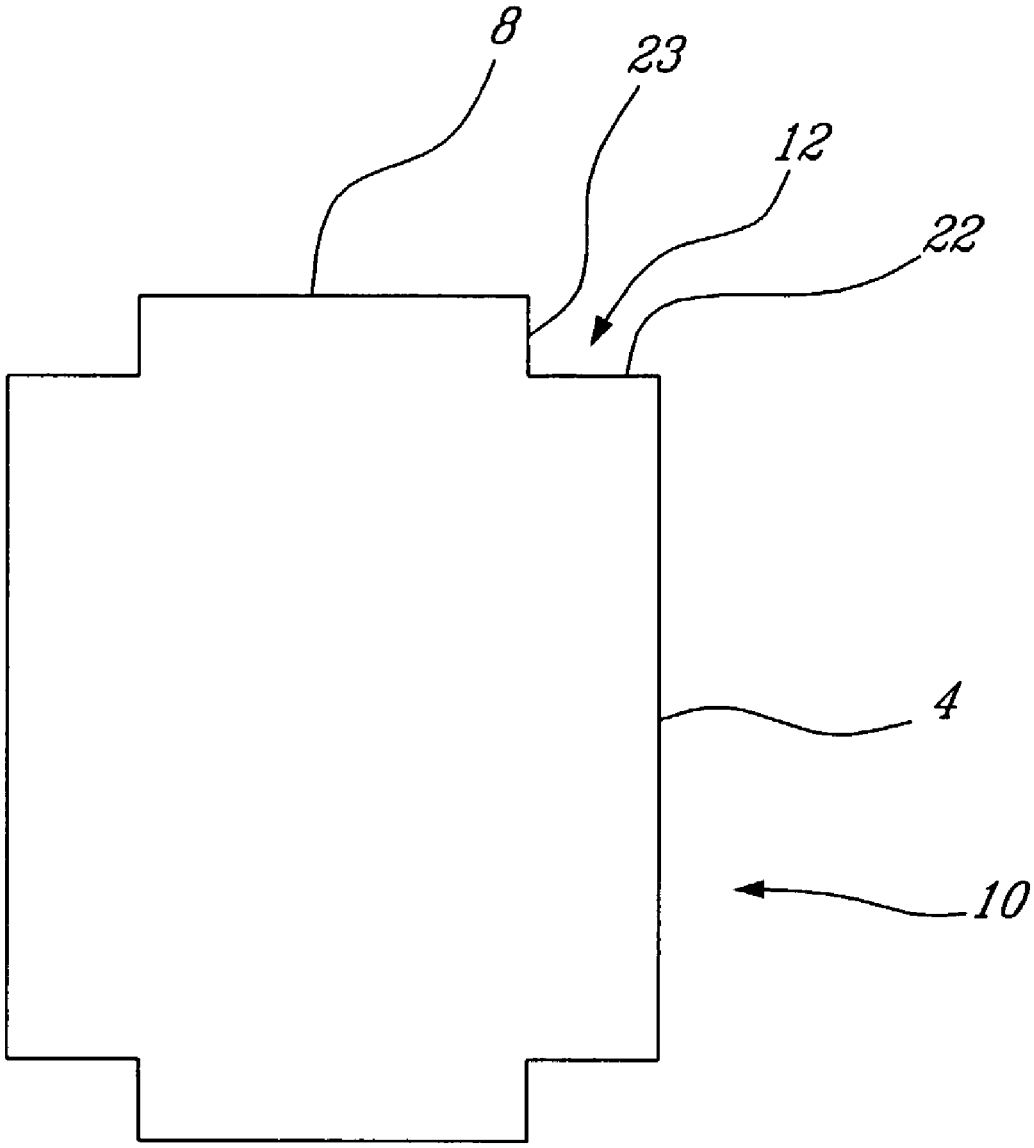
FIG. 36 illustrates an alternative embodiment of a cross section of a hockey stick shaft.

FIG. 35 illustrates an alternative embodiment of the configuration of shaft 10. In this embodiment, no shelf components are disposed adjacent major surface 4 and minor surface 8, rather groove 12 has been configured directly into the side wall 13 and side wall 15 of shaft 10. Further, FIG. 36 illustrates an alternative embodiment, namely a cross section of shaft 10 showing shaft 10 as being full (i.e. not hollow) and grooves 12 being disposed on each of its longitudinal angles.

Alternatively, groove 12 may comprise more than two surfaces, for example FIG. 9 illustrates a groove 12 comprising three surfaces; a first surface 22 relatively perpendicular to major surface 4, a second surface 23 relatively perpendicular to minor surface 8 and a third surface 26 disposed between first surface 22 and second surface 23, for example, diagonally. However, third surface 26 could be curved, i.e. concave. Groove 12 may also comprise a single surface 26 intersecting major surface 4 and minor surface 8 at an angle greater than 90°, such as illustrated by FIG. 10. As illustrated in FIG. 10, the angle between first surface 22 and second surface 23 is substantially 180°. Although each of the first surface 22, second surface 23 and third surface 26 are illustrated in the figures as being substantially flat, the present invention may also include embodiments wherein one, two or all three of the first, second and third surfaces 22, 23, 26 may be curved both longitudinally and laterally, as required or desired. For example, the surfaces may be either convex or concave. Further, a combination of flat and curved surfaces (i.e. longitudinally curved) may be used, as well as a combination of concave or convex shapes (i.e. transversally concave or convex, namely at right angles to the length of the shaft).

Figure 11:
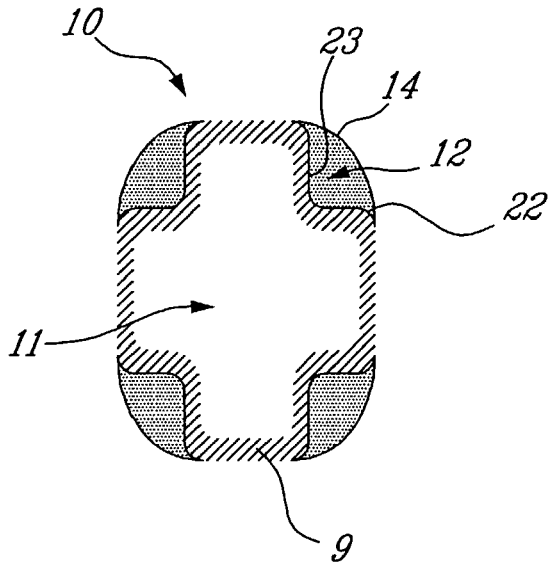
FIGS. 11 to 14 illustrate cross sections of examples of rectangular sports apparatus shafts according to further embodiments of the present invention comprising various examples of possible groove geometries on all four edges.
Figure 12:
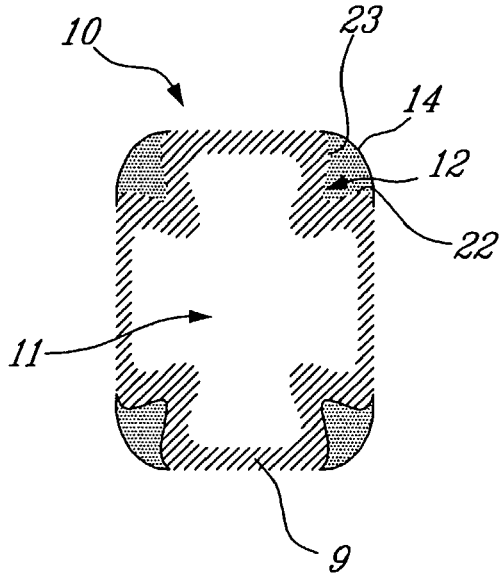
Figure 13:
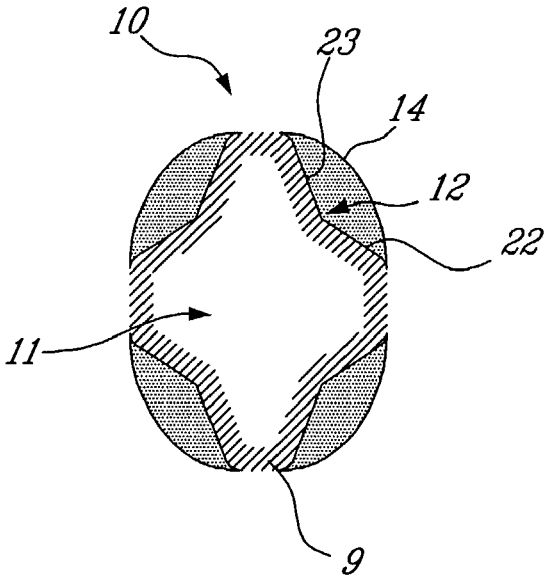
Figure 14:
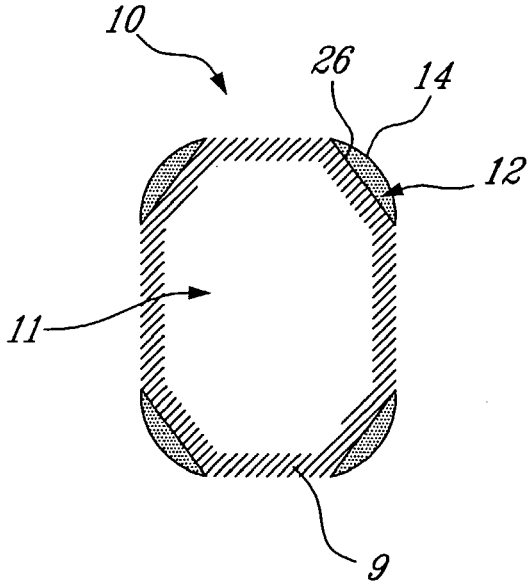
Figure 15:
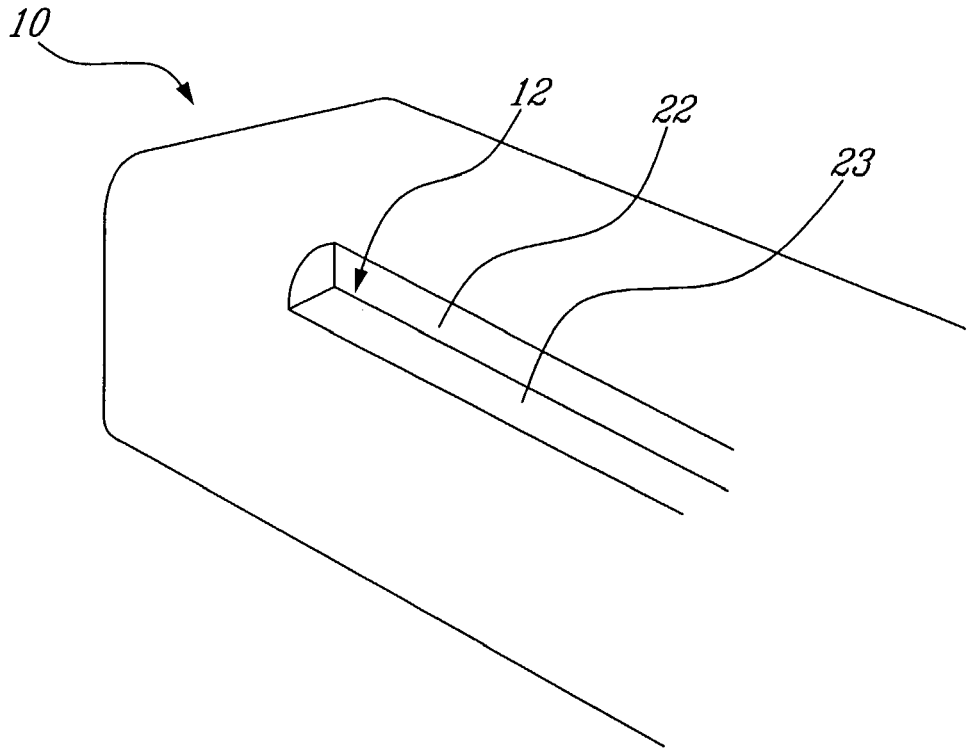
FIGS. 15 to 18 illustrate detailed isometric views of embodiments illustrated in FIGS. 11 to 14 respectively.
Figure 16:
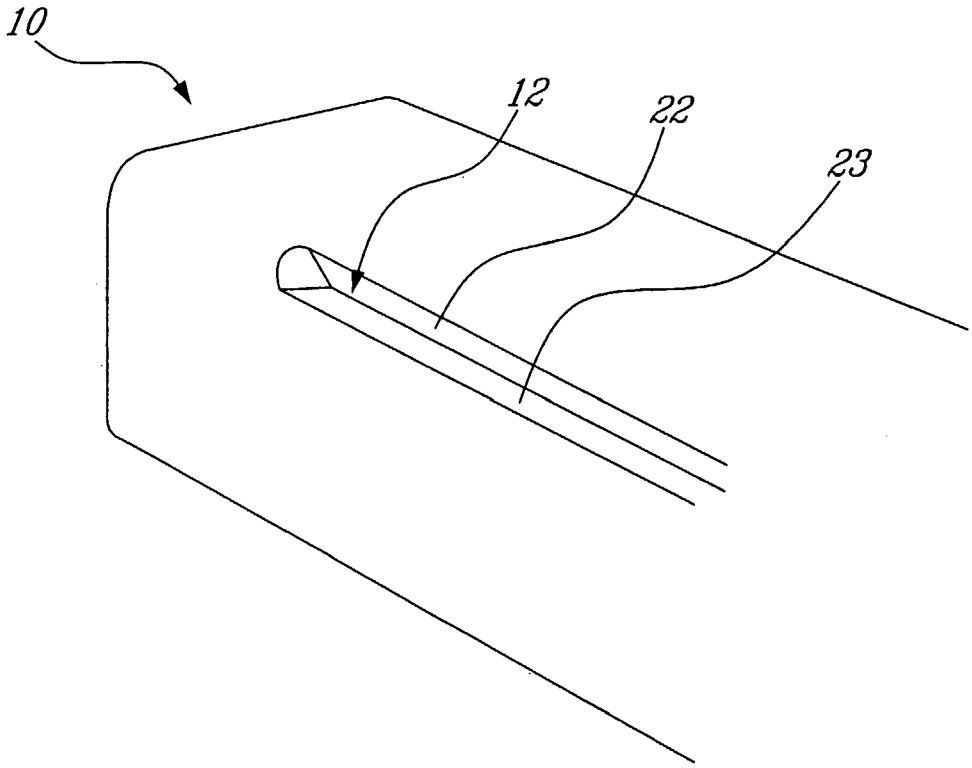
Figure 17:
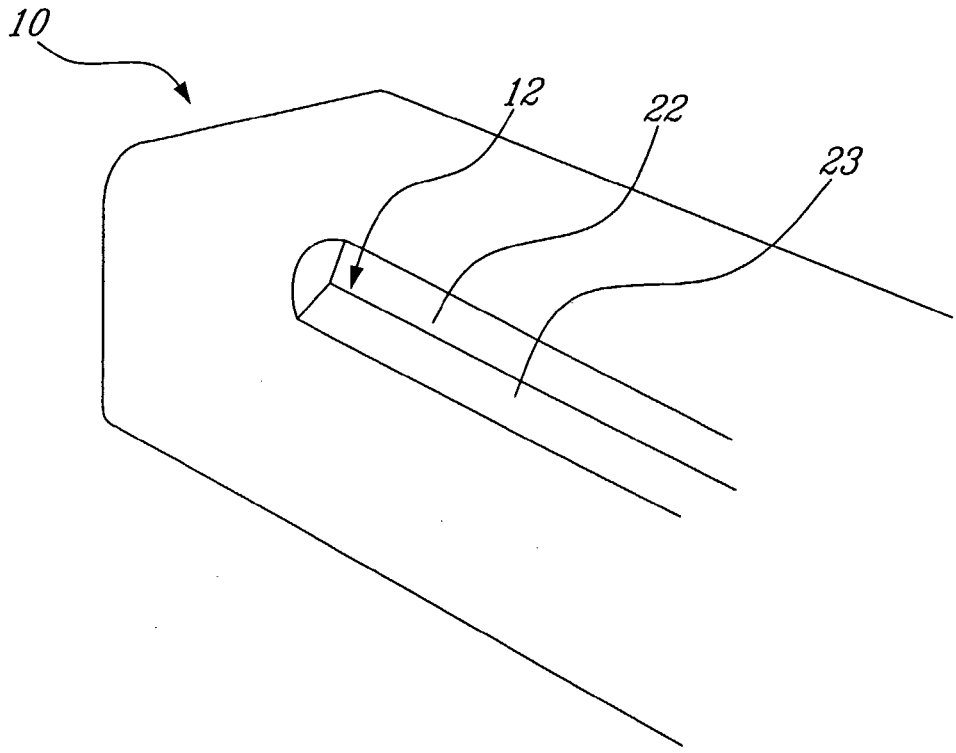
Figure 18:
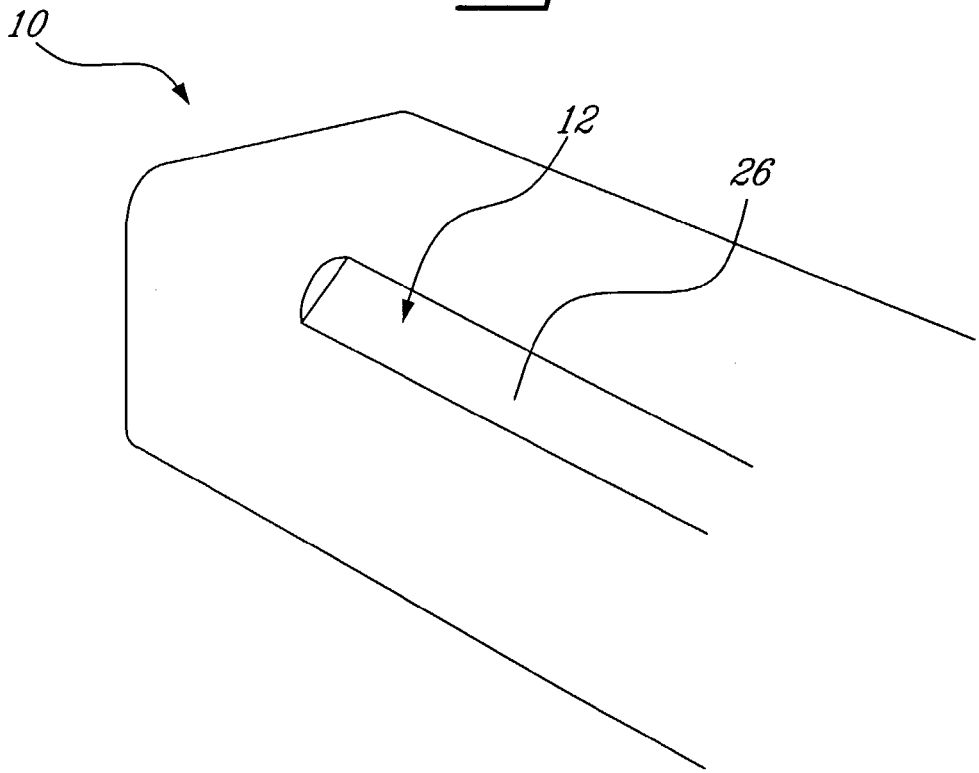

Furthermore, in alternative embodiments, groove 12, surfaces 22 and 23 may intersect each other at varying angles. For example, FIGS. 11 to 13 illustrate cross section views of grooves 12 comprising first 22 and second 23 surfaces intersecting at 90°, less than 90° and at more than 90° respectively. FIG. 14 illustrates a variant where groove 12, surfaces 22 and 23 intersect each other at an angle of 180°, in effect creating a single surface 26 intersecting both major 4 and minor 8 surfaces. FIGS. 15 to 18 illustrate various isometric views of the various grooves.

Figure 19:
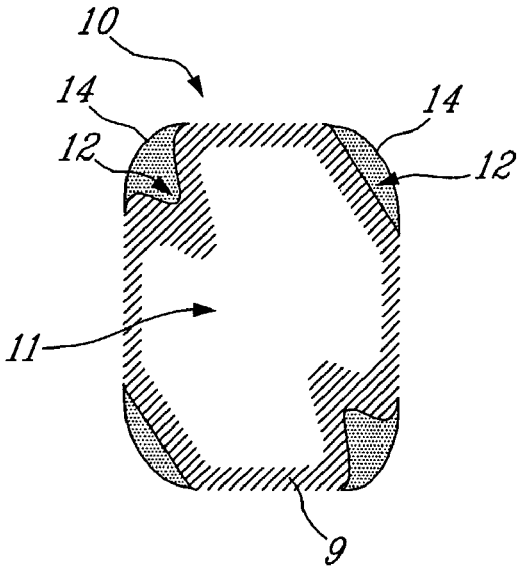
FIGS. 19 to 21 illustrate cross sections of examples of rectangular sports apparatus shafts according to further embodiments of the present invention comprising various examples of possible groove geometries combinations on all or some of the edges.
Figure 20:
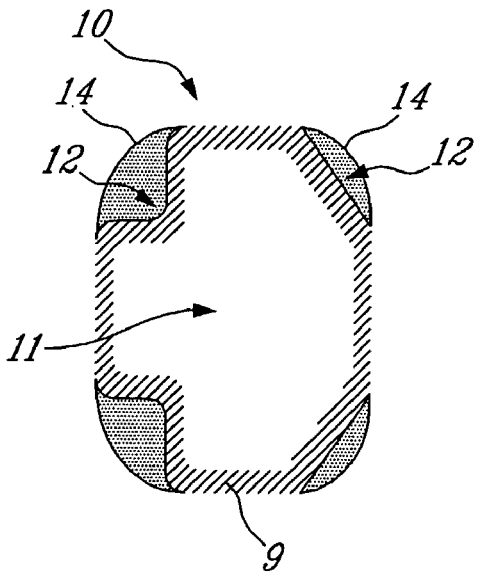
Figure 21:
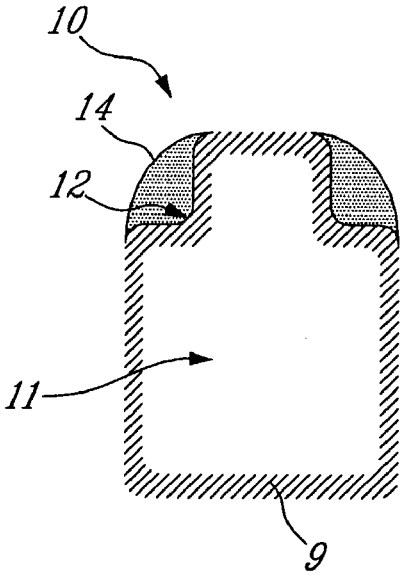

In a further alternative embodiment, all of the grooves 12 need not all be similarly shaped as illustrated in FIGS. 3 to 6 and 11 to 14. FIGS. 19 and 20 illustrate examples of combinations of different groove 12 geometries on the same shaft 10. Other groove 12 geometry combinations than that illustrated in FIGS. 19 and 20 may be possible on the same shaft 10. Also, depending on the application, not all edges of a shaft 10 need be provided with a groove 12 and bumper 14. For example, FIG. 21 illustrates an example of a shaft 10 comprising only two grooves 12 and two corresponding bumpers 14. Alternatively, shaft 10 may comprise only one groove 12 and only one corresponding bumper 14 (not shown). Thus, a rectangular shaft may have as few as one groove 12 and one bumper 14 or as many as four grooves 12 and four bumpers 14. Each groove 12 may have its own specific geometry, which may differ from one or more of the other grooves 12, or may be similar to all of the other ones.

Figure 22:
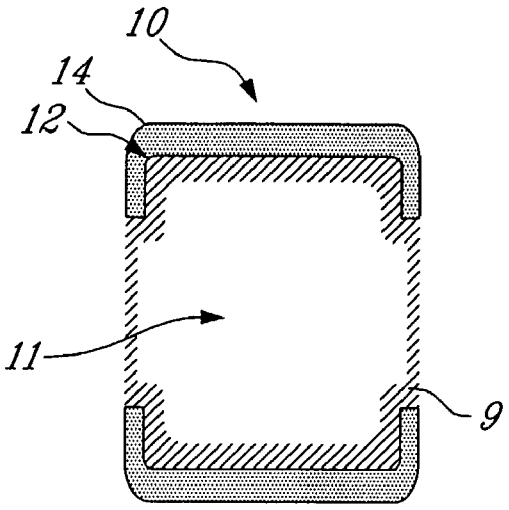
FIGS. 22 and 23 illustrate cross sections of examples of rectangular sports apparatus shafts according to further embodiments of the present invention comprising grooves partially, or completely, covering the surface of the shaft.
Figure 23:
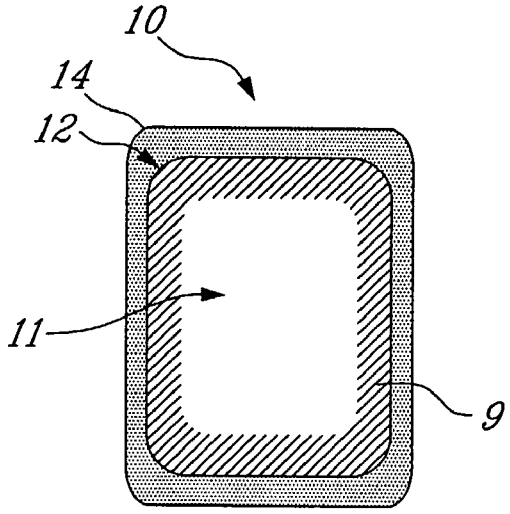
Figure 24:
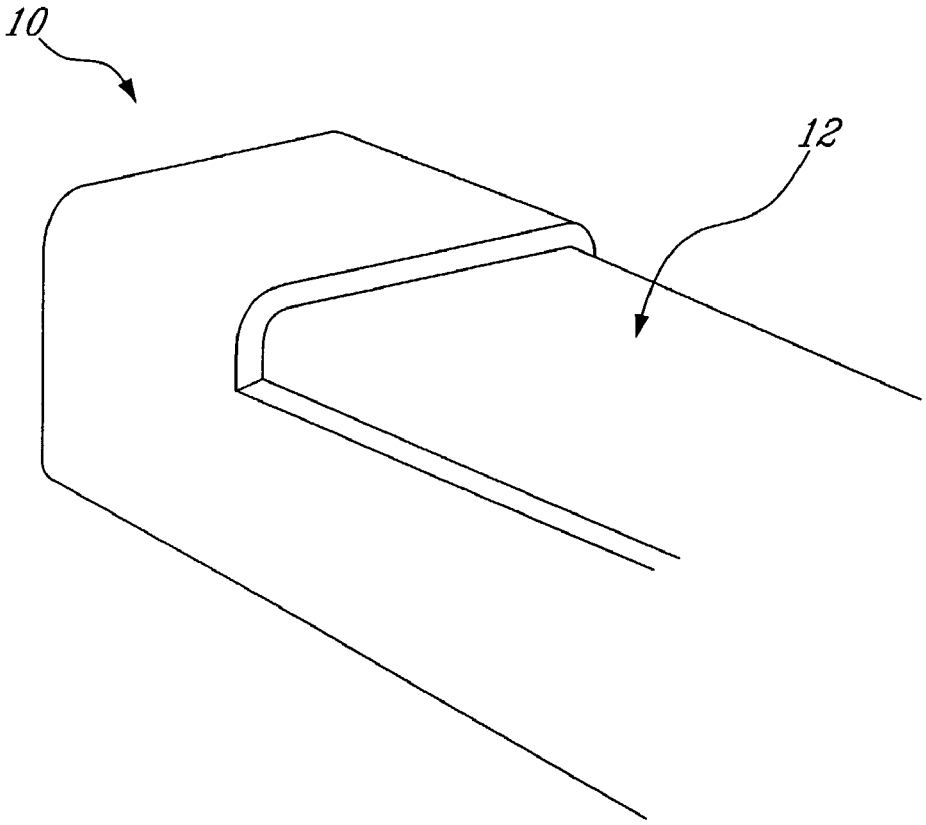
FIG. 24 illustrates a detailed isometric view of the embodiment illustrated in FIG. 22.

In still a further alternative embodiment, a number of grooves 12 may be extended laterally towards an adjacent groove such as to fully cover one or more surfaces of the shaft 10, either partially or completely, as illustrated in FIGS. 22 and 23, thus creating a bumper 14 that may also be used as a grip. FIG. 24 illustrates an isometric view of a groove 12 corresponding to FIG. 22.

Figure 25:
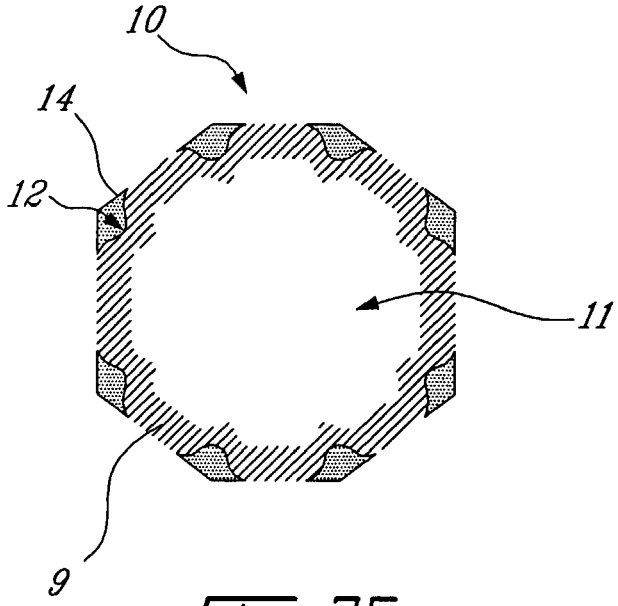
FIG. 25 illustrates a cross section of an example of an eight-sided sports apparatus shafts according to a further embodiment of the present invention.
Figure 26:
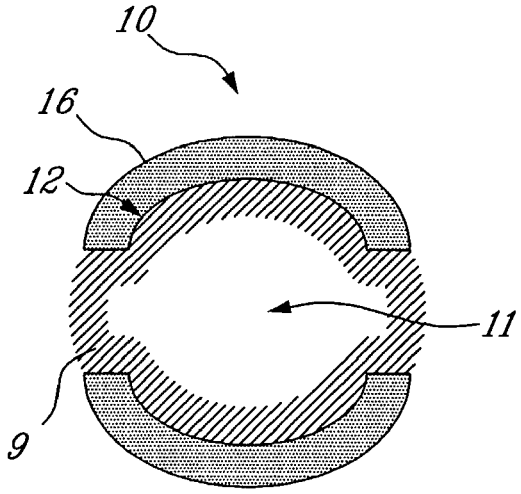
FIGS. 26 and 27 illustrate cross sections of examples of circular sports apparatus shafts according to further embodiments of the present invention comprising grooves partially, or completely, covering the surface of the shaft.
Figure 27:
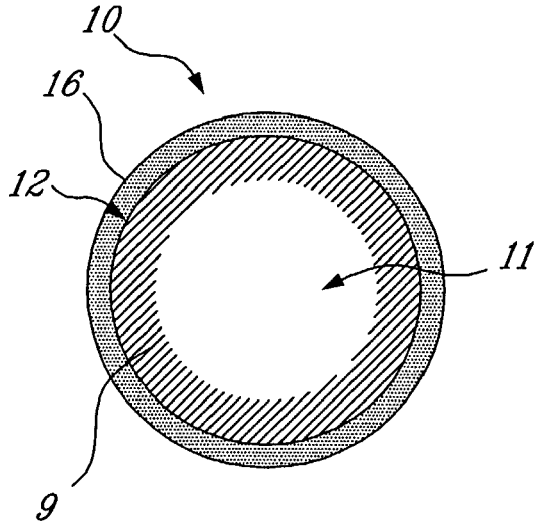

In yet another alternative embodiment, the shaft 10 need not be rectangular, other geometries may be possible as well. For example, FIG. 25 illustrates an eight-sided shaft 10 comprising grooves 12 and bumpers 14 along all its edges. Of course, as in the previous four-sided shaft examples, illustrated by FIGS. 3 to 6 and 19 to 23, variations in the number and geometry of grooves 12 and bumpers 14 apply to shafts with more or less than four sides. Further still, the shaft 10 need not have any edges, such as is the case with a circular shaft as illustrated in FIGS. 26 and 27. In such cases, the groove 12 and bumper may cover the whole surface of the shaft 10 either partially, as illustrated in FIG. 26, or completely, as illustrated in FIG. 27, thus protecting the shaft 10 from impact as well as providing an improved grip.

Figure 28:
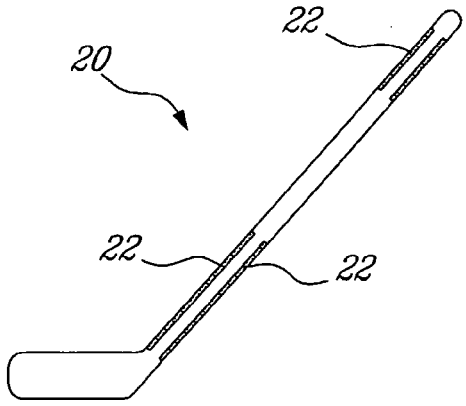
FIGS. 28 to 33 illustrate side views of examples of possible bumper positioning on a hockey stick shaft.
Figure 29:
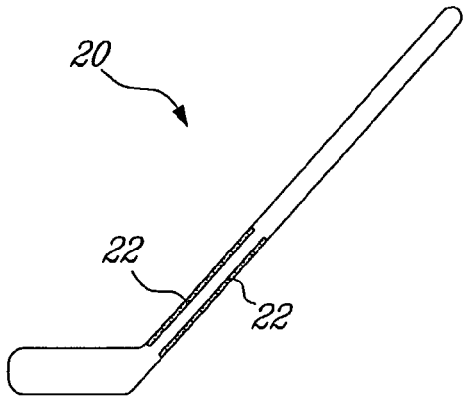
Figure 30:
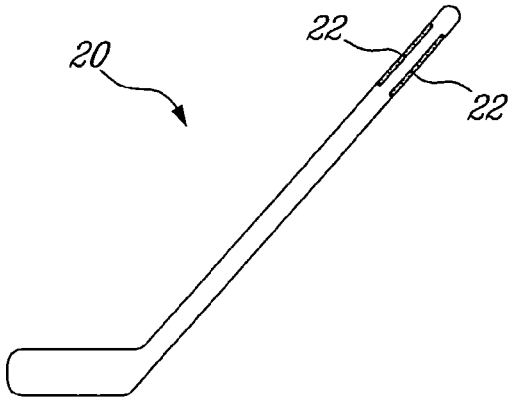
Figure 31:
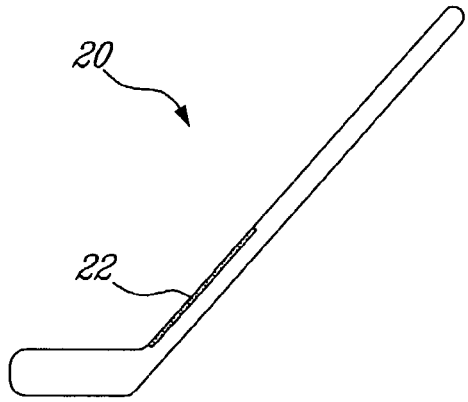
Figure 32:
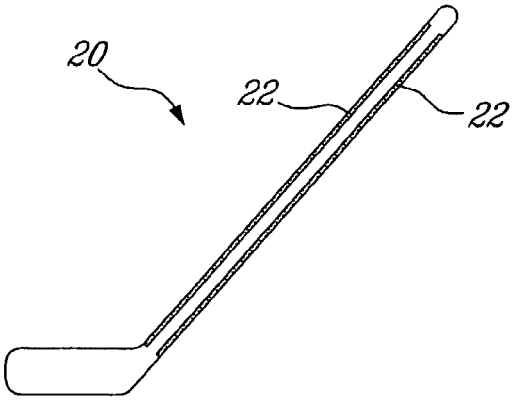
Figure 33:
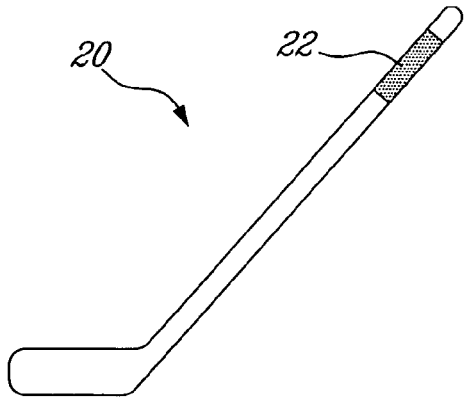

The grooves 12 and bumpers 14 may be located at a number of different locations along the shaft 10, and may extend along either the full length of the shaft 10 or only along a portion. FIGS. 28 to 33 show examples of grooves 12 and bumpers 14 locations on a hockey stick 20. The groove 12 and bumper 14 may be located on specific portions of the hockey stick shaft 20, as shown in FIGS. 28 to 31, or along the whole length of the shaft, as shown in FIG. 32 or a combination thereof. Alternatively, a shaft 20 may have one groove 12 with a bumper 14 along the whole length of the shaft (as illustrated in FIG. 32) and a second groove 12 having two bumpers 14 spaced apart thereon (as illustrated in FIG. 28). A large number of possible combinations are possible to suit any number of requirements. The groove 12 and bumper 14 may also cover entire surfaces, such as shown in FIG. 33, and may be located along any parts of the shaft where impact protection and/or improved grip is desired.

Figure 37:
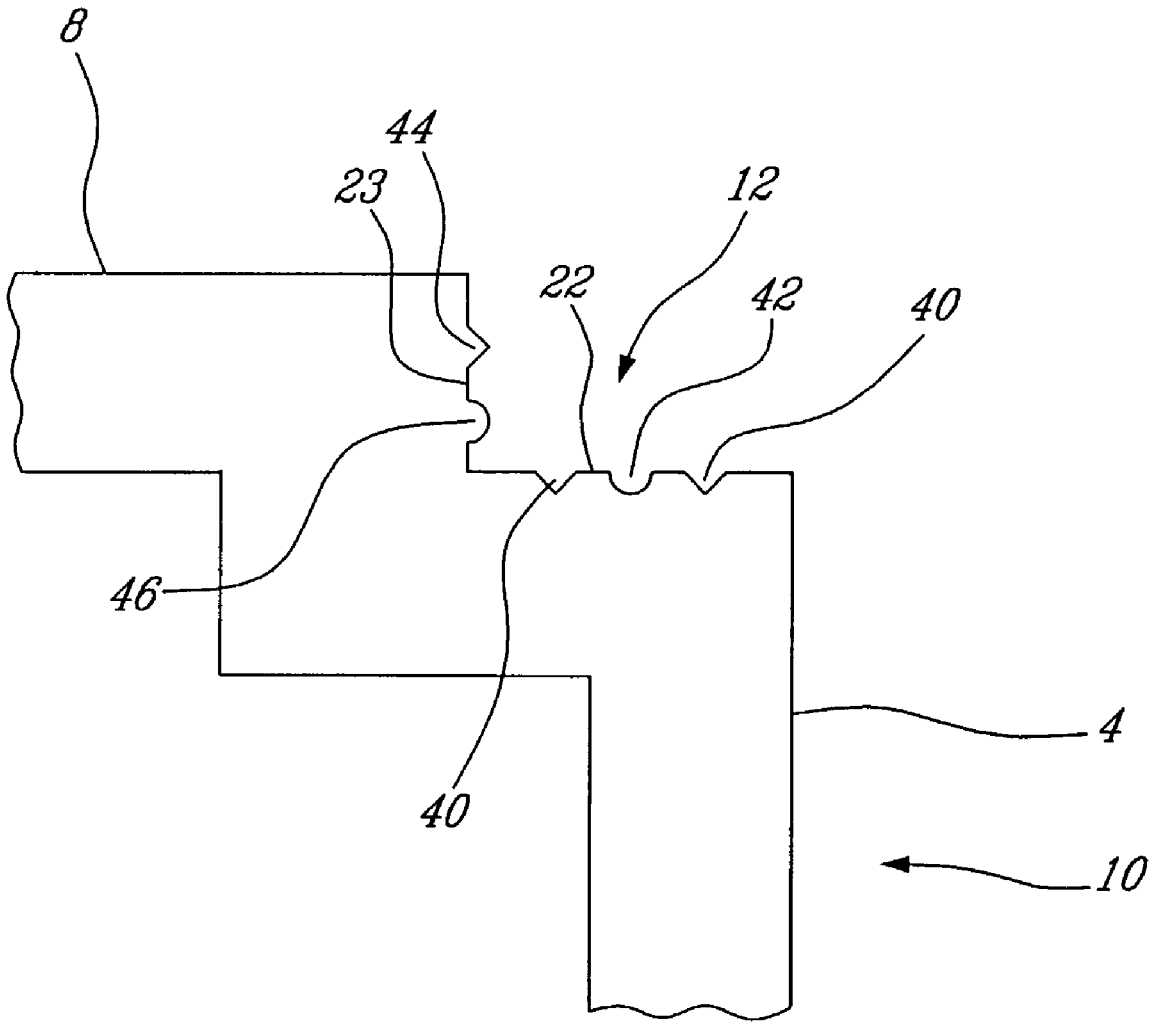
FIG. 37 illustrates a close-up of the surfaces of the groove of a hockey stick shaft.

FIG. 37 illustrates a close-up of first surface 22 and second surface 23 of groove 12. As illustrated, a series of depressions 40 and 42 are disposed in first surface 22. As may be understood, said depressions may facilitate the bonding of the elastomeric material of the bumper 14 (not shown) onto surface 22. The presence of such depressions may, for example, enhance the life of the bumper, reduce or eliminate the need for any bonding agents, or generally increase the serviceability and ability of the bumper to withstand impact. Alternatively, surface 23 is shown having a series of projections 44 and 46 projecting outwardly from said surface. Said projections 44 and 46 may serve the same purpose as the depressions 40 and 42 in that they may facilitate the bonding of the elastomeric material onto said surface. As may be understood, the geometry, disposition and configuration of projections 44 and 46 and/or depressions 40 and 42 may vary and it is further understood that not all surfaces 22 and 23 may be provided with same. Further, any of surface 22 and 23 may be provided with a depression and a projection or any required or desired combination. Also, the depressions and/or projections are illustrated as being disposed longitudinally, i.e. in the direction of the shaft, but it is understood that said projections 44 and 46 and depressions 40 and 42 may be disposed transversal to the longitudinal direction of shaft 10, or at an angle thereto. Finally, projections 44 and 46 and depressions 40 and 42 may be discrete in size, and staggered along surface 22 and/or surface 23.

A variety of known materials may be used in the making of the bumpers. Cast or foamed elastomeric materials may best be suited. A number of such materials and a number of vendors are available from which to choose from. In particular, bumper 14 may be made from thermoplastic polyurethane from the following vendors: Dow, Bayer, 3M, BASF and RTP. Further, bumpers 14 may be made from thermoset polyurethane, available from the following vendors: DuPont, Bayer, Henkel, BJB Enterprises, General Electric and NuSil, Cytec Innovatives. Further, bumper 14 may also be made from silicone rubber, available from Dow Corning, Silicones Inc. and Bayer. Bumper 14 may also be made from polyisoprene (natural rubber) available from Lavelle. Bumper 14 may also be made from polybutadiene available from Bayer. Bumper 14 may also be made from polyisobutylene available from PRC DeSoto. Further, bumper 14 may also be made from latex available from Dow or DuPont. As may be understood, additional materials, either known or unknown, may be used insofar as they have sufficient elastomeric properties and may adequately bond to the groove 12. Further, any other material which is suitable at dissipating energy from an impact may be substituted for any of the above. As may be understood, if a shaft 10 comprises more than one groove 12, each said groove 12 may comprise a bumper made, for example, from one of the previously listed materials such that, for example, a shaft 10 may have three grooves 12, each having a bumper 14 disposed therein, each made from a different material. Further, a groove may comprise two or more of the materials listed above, for example, either be mixed or one material being disposed in a discrete section of a groove while the other material may be disposed adjacent or space therefrom. The range of hardness or Durometer of the bumper 14 material could be anywhere from 10 Shore A to 80 Shore D, depending upon the desire to balance between feel, i.e. softness of the bumper 14 and the energy dissipation ability of the material as well as its durability.

Figure 34:
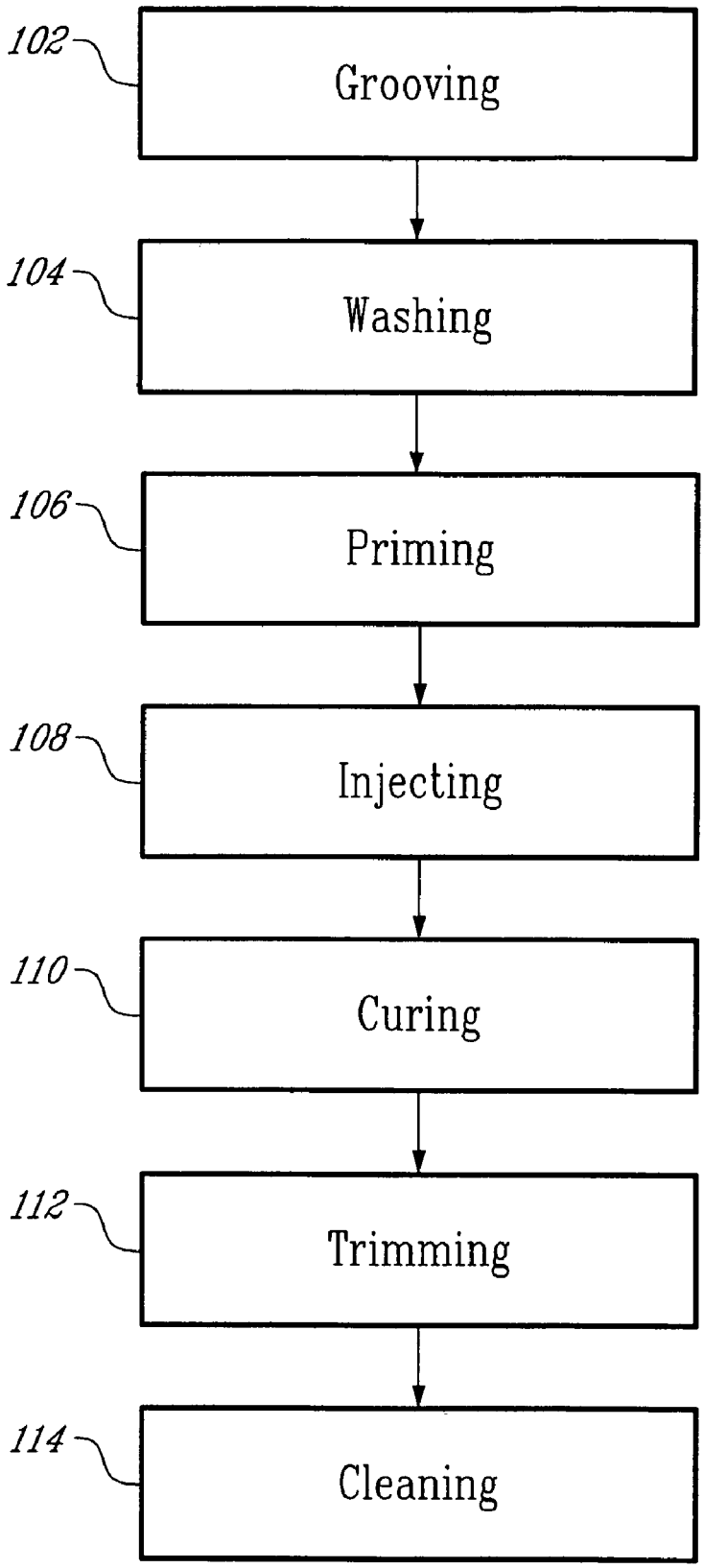
FIG. 34 illustrates a generalized flow chart of the manufacturing process used to produce the sports apparatus shafts with an elastomeric material such as, for example, thermoset elastomeric urethane bumpers.

In FIG. 34 there is shown a flow chart that depicts the manufacturing process used to produce the sports apparatus shafts 10 with thermoset elastomeric urethane bumpers 14. The sequences of steps performed is indicated by the sequence of blocks 102 to 114.

In block 102, the sports apparatus shaft 10 is provided with grooves 12 where bumpers 14 are to be located in order to allow for the attachment or deposit therein of an elastomeric material, such as elastomeric urethane. Their number, positioning and geometry may vary according to the desired application. In the case of a solid shaft 10 such as, for example, a wooden hockey stick 20, the grooves 12 may be mechanically machined into the shaft 10. Alternatively, in the case of a composite hockey stick 20, the grooves may be made when the shaft 10 is bladder molded or otherwise constructed according to known techniques. The composite stick 20 may, for example, be bladder molded using hard tooling to define its outer geometry. The tooling geometry may include recesses in the edges, or surfaces, to form the grooves 12. Bladder molding is a composite process where a prepreg preform is created using a mandrel. This preform is then cured under heat and pressure using an internal bladder to apply pressure to the composite prepreg preform. The hard tooling is placed in a heated press which heats the tool and provides the force necessary to keep the hard tooling closed when the internal bladder pressure is being applied to the composite prepreg preform. The bladder molded composite sports apparatus shaft 10 is then removed from the tooling, deflashed, i.e. excess material is removed. Further, an aluminum oxide blast is administered to eliminate the mold release transferred during the composite bladder molding process.

Then, at block 104, the sports apparatus shaft 10 is washed and rinsed to eliminate any contaminants on the surface of the grooves 12 prior to secondary bonding of the elastomeric material, (i.e. urethane). In the case of a composite shaft 10, conventional mold release cleaner may be used for this purpose.

At block 106, after the grooves 12 are (blast) prepared and cleaned of any surface contaminants, both a primer for adhesion to the composite and an adhesive for adhesion to the elastomeric material may be sprayed over the area of the grooves 12 to be bonded with the elastomeric material in two separate steps. The primer and adhesive layers may be post-cured separately or together and either may or may not be needed depending on the level of bond strength required for the product or depending on the properties of the elastomeric material.

Following which, at block 108, the cleaned and surface-prepared shaft 10 is inserted into custom-designed heated aluminum/silicone hybrid tooling for injection of an elastomeric material, for example, an elastomeric urethane. The shaft 10 is inserted into the tooling where the aluminum portion locates the grooves 12 and the silicone portion (when heated) provides a tight seal against the grooves 12, leaving a cavity for injection of the elastomeric material (urethane) into the cavity created between the silicone portion of the hybrid tooling and the grooves 12. The shaft 10 may be disposed in the aluminum/silicone hybrid injection tooling so that when the tool is securely closed, elastomeric urethane may be injected through a manifold system attached to the aluminum/silicone hybrid tooling. The tool may be provided with a number of ways of injecting the elastomeric material, for example, one or more injection ports strategically located so as to maximize the efficiency of the injection process. For example, two or more injection ports may be provided, one injection port may fill half of the grooves 12, then the second injection port may fill the other half. The elastomeric material (urethane) may be continuously injected until it leaves through one or more vent manifolds which may be located at the top of the tooling. At this point the injection is stopped and the injection hole plugged.

Then, at block 110, the hybrid tooling and molded elastomeric urethane is allowed to sit in order to cure.

At block 112, once the urethane is cured, the manifolds are pulled off and excess urethane from the injection systems is removed and discarded. The sports apparatus shaft 10 is removed from the tooling and any excess urethane overflow on the shaft 10 is cleaned, either mechanically or with a solvent, and the injection and vent sprues are removed by trimming, for example, with a curved razorblade.

Finally, at block 114, the sports apparatus shaft 10 is ready for secondary cleaning before application of paint and decals. Alternatively, the shaft 10 may then be affixed with a blade.

It should be noted that the particular embodiment of the manufacturing process illustrated by the flow chart of FIG. 34 uses hard tooling such as Computer Numerical Control (CNC) milled aluminum hard tooling, but there are a number of other tooling which may alternatively be used, for example using aluminum-filled epoxies, soft tooling and other castable tooling methods.

In addition to the above, a variety of different methods for attachment of the bumper 14 into the groove 12 have been identified. For example, if an injection molding process is to be used, thermoplastic elastomers may be used in addition to a CNC tool steel or aluminum. If an injection overmolding process is to be used, a thermoset elastomer may be used in conjunction with a CNC tool steel or aluminum, having a cast elastomeric silicone. If any of the following methods, namely pressure molding, compression molding, gravity casting or vacuum casting is to be used, CNC tool steel or aluminum methods may be employed. Finally, in the case of a method known as secondary bonding, such that the elastomeric bumper 14 is pre-cured, then bonded or glued to the groove 12 on the shaft, aluminum or steel alignment jigs and fixtures may be used.

The elastomers of the present invention can be cured at a range of temperatures. For example, they can be cured from room temperature up to elevated temperatures approaching, or even over the boiling point of water. Further, in some cases, the upper temperature limit of the curing can be the transition temperature of, for example, the carbon fibers of the shaft 10 itself, namely 290° F. Further, the elastomers can be injected into the tooling at a variety of pressures, for example, 20 to 40 pounds per square inch. The proper mix of temperature and pressure can be varied depending on various conditions and desired final properties, since a too fast a cure may create cosmetic issues while a too slow curing period will naturally increase the price of the final product. Ideally, the combination of time, temperature and pressure will allow for bumpers 14 to have increased ability to absorb edge-impact energy, possibly up to 350% more edge-impact energy absorbed when compared with a standard composite hockey shaft having the same geometry, construction but without any elastomeric bumpers 14. In addition to increased ability to absorb edge-impact energy, the present invention may have increased vibration dampening. The elastomeric materials of the bumper 14 and the grooves 12 allow for less vibration from the impacts subjected to the stick to be transferred into the player's hands, resulting in less damage to the player's joints over time. Further, the elastomeric bumpers 14 may provide increased grip ability for the player. The elastomeric nature of the bumpers 14 may give a player a better grip on the hockey shaft.

It is understood that the curing of the elastomer occurs within the molding tooling. However, it is understood that the curing of the elastomeric material may, according to the elastomeric material itself, occur outside of the tooling.

Figure 38:
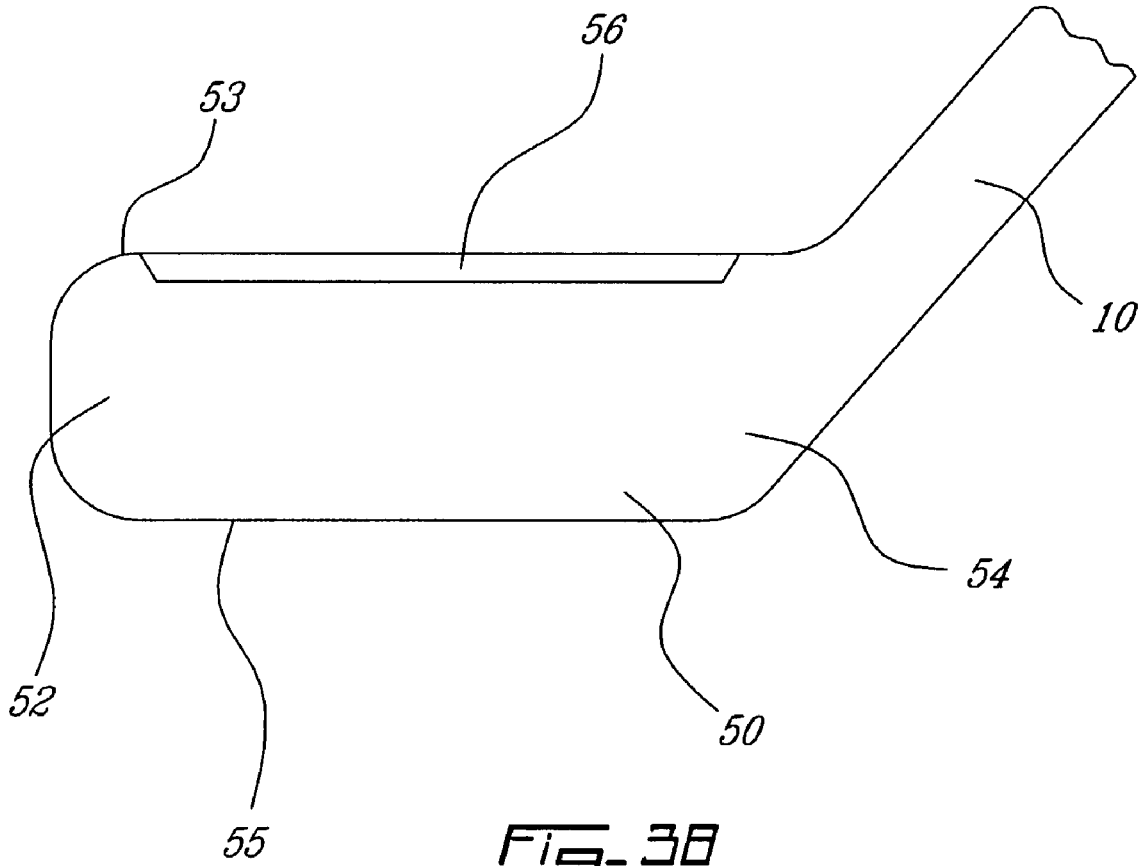
FIG. 38 illustrates an alternative embodiment of the present invention wherein a bumper is provided on the blade of a hockey stick.

FIG. 38 illustrates a further application of the present invention. As illustrated, a hockey stick shaft 10 is shown having a blade 50 affixed thereto. Blade 50 comprises a toe portion 52 and a heel portion 54, said heel portion 54 being adjacent the bottommost portion of shaft 10. Blade 50 further comprises a top surface 53 and a bottom surface 55, being understood that bottom surface 55 will be in contact with the ice while the stick is in play. Top surface 53 comprises a groove, which groove is disposed substantially along the whole length of top surface 53. The groove has been filled with a bumper 56, and it will be understood that bumper 56 has as a purpose the absorption of impact on the top surface 53 of blade 50. Although shown as being disposed only along a portion of top surface 53, bumper 56 may be disposed along the entire length thereof. Alternatively, a bumper 56 could be provided on the bottom surface 55.

Figure 39:
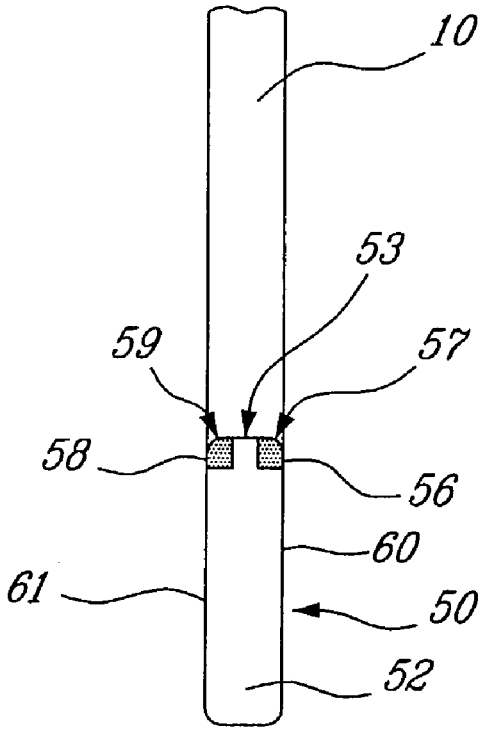
FIG. 39 is a front elevation view of the blade of FIG. 38.
Figure 40:
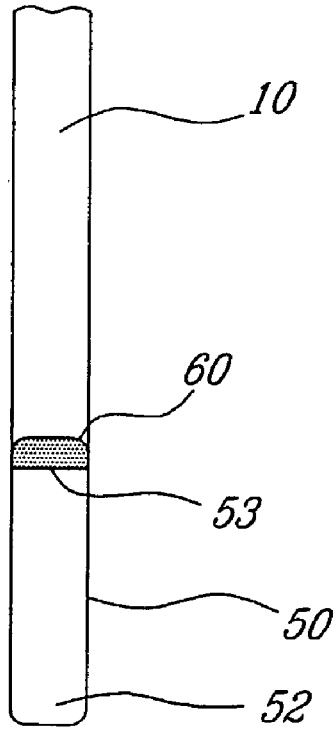
FIG. 40 is a front end elevation view of an alternative embodiment of the blade of FIG. 39.

FIG. 39 illustrates a front end elevation view of blade 50 of FIG. 38, showing opposed first and second lateral side faces 60, 61. As shown, the top surface 53 comprises two grooves 57 and 59, which grooves have been filled by bumpers 56 and 58 respectively. It will be understood that the geometries, configurations and dispositions of grooves 57 and 59 may be similar to or even identical to the grooves 12 of FIGS. 5 through 14, and that the same types of materials, configuration, shapes and combinations of these as described above with respect to the shaft may equally apply to the blade. Further, as illustrated in FIG. 40, the top surface 53 of blade 50 may not comprise a groove therein, but may simply be provided with a bumper 60 disposed along its entire lateral surface.

Variations and modifications are possible within the scope of foregoing disclosure, the drawings and the appended claims to the inventions.

We claim:

1. A sports shaft comprising:

an elongated body comprising opposed first and second major side surfaces spacing apart opposed first and second minor side surfaces, each said major surface having two lateral major edges disposed along the length of said elongated body, each said minor surface having two lateral minor edges disposed along the length of the elongated body, each said major edge abutting an adjacent minor edge along its entire length forming four angles along the longitudinal periphery of said body, at least one of said angles comprising a longitudinally disposed groove therein, said groove comprising a first face disposed adjacent said major surface and a second face disposed adjacent said minor surface, said first and second faces intersecting each other for the length of the groove, each groove being filled with an elastomeric material with the elastomeric material being present only within a volume bounded by said first face, by said second face, by a first plane projecting from and being parallel to said major surface and by a second plane projecting from and being parallel to said minor surface.

2. The sports shaft of claim 1 wherein said elastomeric material is selected from a group comprising: thermoset elastomeric urethane, thermoplastic polyurethane thermoset elastomer dicyclopentadiene, thermoplastic elastomer, thermoplastic urethane, silicone, rubber, polyisoprene, polybutadiene, polyisobutylene and latex.

3. The sports shaft of claim 1 wherein said first face is disposed substantially perpendicularly to said major surface.

4. The sports shaft of claim 1 wherein said second face is disposed substantially perpendicularly to said minor surface.

5. The sports shaft of claim 1 wherein said first and said second faces are both disposed perpendicularly to said major surface and said minor surface.

6. The sports shaft of claims 1 wherein said elastomeric material fills the volume bounded by said first face, by said second face, by a first plane projecting from and being parallel to said major surface and by a second plane projecting from and being parallel to said minor surface.

7. The sports shaft of claim 1 wherein the groove is a first groove, the at least one said angle comprises a second groove separate and spaced apart from the first grooves, the second groove being filled with elastomeric material.

8. The sports shaft of claim 7 wherein the at least one of said angles include at least two of said angles.

9. The sports shaft of claim 1 wherein said groove is disposed along only a longitudinal portion of said angle.

10. The sports shaft of claim 1 wherein said elastomeric material is shaped such that its exterior shape is undulating.

11. The sports shaft of claim 1 wherein said first face and said second face are coplanar.

12. The sports shaft of claim 1 wherein said first face and said second face are the same size.

13. The sports shaft of claim 1 wherein said elastomeric material fills a volume which is bounded by said first face, by said second face and by the segment of an arc, said segment of an arc beginning at the intersection of said first face and said major surface and ending at the intersection of said second face and said minor surface.

14. The sports shaft of claim 13 wherein said segment of an arc begins at either one of said minor surface adjacent said second face or at said major surface adjacent said first face.

15. The sports shaft of claim 13 wherein said segment of an arc begins on said major surface adjacent said first face and ends on said minor surface adjacent said second face.

16. The sports shaft of claim 1 wherein at least one of said first and second faces comprises at least one depression therein.

17. The sports shaft of claim 16 wherein said at least one depression is disposed longitudinally to the length of said groove.

18. The sports shaft of claim 16 wherein said depression is disposed perpendicularly to the length of said groove.

19. The sports shaft of claim 1 wherein at least one of said first and second faces comprises at least one raised portion thereon.

20. The sports shaft of claim 19 wherein said at least one raised portion is disposed longitudinally to the length of said groove.

21. The sports shaft of claim 19 wherein said raised portion is disposed perpendicularly to the length of said groove.

22. The sports shaft of claim 1 wherein said shaft is a hockey shaft.

23. A sports shaft comprising:

an elongated body comprising opposed first and second major wall components spacing apart opposed first and second minor wall components, said first major wall component comprising a first shelf component adjacent said first major wall component, said first shelf component projecting from said first major wall component towards said second major wall component, said first shelf component having a first distal end, said first minor wall component comprising a second shelf component adjacent said first minor wall component, said second shelf component projecting from said first minor wall component towards said second minor wall component, said second shelf component having a second distal end, wherein said first and second distal ends meet forming a groove on the outside of said elongated body, said groove being filled with an elongated bumper made of an elastomeric material and located only within a volume bounded by said first shelf component, by said second shelf component, by a first plane projecting from and being parallel to said major wall component and by a second plane projecting from and being parallel to said minor wall component.

24. The sports shaft of claim 23 wherein said elastomeric material is selected from a group comprising: thermoset elastomeric urethane, thermoplastic polyurethane, thermoset elastomer dicyclopentadiene, thermoplastic elastomer, thermoplastic urethane, silicone, rubber, polyisoprene, polybutadiene, polyisobutylene and latex.

25. The sports shaft of claim 23 wherein said first shelf component is disposed substantially perpendicularly to said major wall component.

26. The sports shaft of claim 23 wherein said second shelf component is disposed substantially perpendicularly to said minor wall component.

27. The sports shaft of claim 23 wherein said first and said second shelf components are both disposed perpendicularly to said major wall component and said minor wall component.

28. The sports shaft of claims 23 wherein said elastomeric material fills the volume bounded by said first shelf component, by said second shelf component, by a first plane projecting from and being parallel to said major wall component and by a second plane projecting from and being parallel to said minor wall component.

29. The sports shaft of claim 23 wherein the groove is a first groove, the shaft further comprising a second groove separate and spaced apart from the first groove and filled with a second bumper made of the elastomeric material.

30. The sports shaft of claim 23 wherein said groove is disposed along only a longitudinal portion of said elongated body.

31. The sports shaft of claim 23 wherein each bumper is shaped such that its exterior shape is undulating.

32. The sports shaft of claim 23 wherein said first shelf component and said second shelf component are the same size.

33. The sports shaft of claim 23 wherein said elastomeric material fills a volume which is bounded by said first shelf component, by said second shelf component and by the segment of an arc, said segment of an arc beginning at the intersection of said first shelf component and said major wall component and ending at the intersection of said second shelf component and said minor wall component.

34. The sports shaft of claim 33 wherein said segment of an arc begins at either one of said minor wall component adjacent said second shelf component or at said major wall component adjacent said first shelf component.

35. The sports shaft of claim 33 wherein said segment of an arc begins on said major wall component adjacent said first shelf component and ends on said minor wall component adjacent said second shelf component.

36. The sports shaft of claim 23 wherein at least one of said first and second shelf components comprises at least one depression therein.

37. The sports shaft of claim 36 wherein said at least one depression is disposed longitudinally to the length of said groove.

38. The sports shaft of claim 36 wherein said depression is disposed perpendicularly to the length of said groove.

39. The sports shaft of claim 23 wherein at least one of said first and second shelf components comprises at least one raised portion thereon.

40. The sports shaft of claim 39 wherein said at least one raised portion is disposed longitudinally to the length of said groove.

41. The sports shaft of claim 39 wherein said raised portion is disposed perpendicularly to the length of said groove.

42. The sports shaft of claim 23 wherein said shaft is a hockey shaft.

43. A method of fabricating a sports shaft comprising the steps of:

placing a preformed sports shaft comprising an elongated body comprising opposed first and second major side surfaces spacing apart opposed first and second minor side surfaces, each said major surface having two lateral major edges disposed along the length of said elongated body, each said minor surface having two lateral minor edges disposed along the length of said elongated body, each said major edge abutting an adjacent minor edge along its entire length forming four angles along the longitudinal periphery of said body, at least one of said angles comprising a longitudinally disposed groove therein, said groove comprising a first face disposed adjacent said major surface and a second face disposed adjacent said minor surface, said first and second faces each intersecting each other for the length of the groove, into a first mold section, closing a second mold section around said preformed sports shaft, injecting an elastomeric material into the closed mold such that the groove becomes filled with elastomeric material while containing the elastomeric material within a volume bounded by said first face, by said second face, by a first plane projecting from and being parallel to said major surface and by a second plane projecting from and being parallel to said minor surface, and removing said sports shaft from said mold.

44. The method of claim 43 wherein said elastomeric material is selected from a group comprising: thermoset elastomeric urethane, thermoplastic polyurethane, thermoset elastomer dicyclopentadiene, thermoplastic elastomer, thermoplastic urethane, silicone, rubber, polyisoprene, polybutadiene, polyisobutylene and latex.

45. The method of claim 43 further comprising curing the injected elastomeric material at a temperatures between room temperature and 290° F.

46. The method of claim 43 wherein the elastomeric material is injected into the mold at a pressure of from 20 to 40 pounds per square inch.

* * * * *

UNITED STATES PATENT AND TRADEMARK OFFICE

CERTIFICATE OF CORRECTION

PATENT NO. : 8,052,551 B2
APPLICATION NO. : 10/590701
DATED : November 8, 2011
INVENTOR(S) : Ray Blotteaux, Justin Roth and Michael Thomas Bennett It is certified that error appears in the above-identified patent and that said Letters Patent is hereby corrected as shown below:

Col. 16, lines 38-40;

Correction to Claim 45 to change temperatures to temperature

45. The method of claim 43 further comprising curing the injected elastomeric material at a temperature between room temperature and 290° F.

Signed and Sealed this
Third Day of April, 2012

David J. Kappos

David J. Kappos
*Director of the United States Patent and Trademark Office*